US010364119B2

(12) United States Patent
Uchibori et al.

(10) Patent No.: US 10,364,119 B2
(45) Date of Patent: Jul. 30, 2019

(54) RECORDING APPARATUS

(71) Applicant: SEIKO EPSON CORPORATION, Tokyo (JP)

(72) Inventors: Kenji Uchibori, Matsumoto (JP); Kazunori Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/045,398

(22) Filed: Jul. 25, 2018

(65) Prior Publication Data

US 2019/0031461 A1 Jan. 31, 2019

(30) Foreign Application Priority Data

Jul. 28, 2017 (JP) ..... 2017-147021
Feb. 28, 2018 (JP) ..... 2018-035273

(51) Int. Cl.

| | |
|---|---|
| ***B65H 31/10*** | (2006.01) |
| ***B65H 7/20*** | (2006.01) |
| ***B65H 1/04*** | (2006.01) |
| ***G03G 21/16*** | (2006.01) |
| ***G03G 15/00*** | (2006.01) |

(52) U.S. Cl.

CPC ..... *B65H 31/10* (2013.01); *B65H 1/04* (2013.01); *B65H 7/20* (2013.01); *G03G 15/6552* (2013.01); *G03G 21/1604* (2013.01); *B65H 2405/114* (2013.01); *B65H 2405/3322* (2013.01); *B65H 2511/12* (2013.01); *B65H 2511/22* (2013.01); *B65H 2801/06* (2013.01)

(58) Field of Classification Search

CPC ..... B65H 2405/3322; B65H 31/04; B65H 31/08; B65H 31/10; B65H 1/04; G03G 21/1604

See application file for complete search history.

(56) References Cited

U.S. PATENT DOCUMENTS

| | | | | |
|---|---|---|---|---|
| 2002/0117796 | A1* | 8/2002 | Miyamoto | B41J 11/0055 271/3.14 |
| 2007/0170637 | A1* | 7/2007 | Asada | B65H 1/04 271/3.14 |
| 2009/0041525 | A1* | 2/2009 | Kunioka | B65H 1/266 400/207 |
| 2009/0218749 | A1* | 9/2009 | Shingai | B65H 31/02 271/3.14 |
| 2009/0322010 | A1* | 12/2009 | Kusama | B65H 29/58 271/3.14 |
| 2018/0201459 | A1* | 7/2018 | Yamaguchi | B65H 5/26 |

FOREIGN PATENT DOCUMENTS

| | | | |
|---|---|---|---|
| JP | 05-155500 | A | 6/1993 |
| JP | 2007320670 | A * | 12/2007 |

* cited by examiner

*Primary Examiner* — Patrick Cicchino
(74) *Attorney, Agent, or Firm* — Workman Nydegger

(57) ABSTRACT

A recording apparatus is provided that is able to increase the medium load capacity of a receiving portion in a configuration provided with a mounting portion and receiving portion.

9 Claims, 11 Drawing Sheets

RECORDING APPARATUS

BACKGROUND

1. Technical Field

The present disclosure relates to a recording apparatus provided with a receiving portion, such as a stacker, that receives a recording medium that is discharged from a discharge port after recording on a medium such as a paper sheet.

2. Related Art

JP-A-5-155500 discloses a recording apparatus, such as a multifunction printer, provided with a stacker (one example of a receiving portion) that receives a medium (recording medium) that is discharged from a discharge port after recording (printing) on a medium such as a paper sheet. A stacker provided in a recording apparatus such as a multifunction printer assuming high-volume printing is typically configured such that a distance in a vertical direction from the discharge port up to a receiving surface of the stacker is set to be long so as to be able to load (stack) a large volume of the recording medium. In this case, a time at which influence of air resistance is received becomes long since the recording medium is discharged until being grounded on the receiving surface of the stacker or on an upper surface of the recording medium on the receiving surface. When the recording medium while dropping receives influence of air resistance, the recording medium is randomly moved, and as a result, alignment of recording medium bundles (for example, paper sheet bundles) that are loaded on the stacker is worsened. In this case, the recording medium bundles for which alignment is worsened have to be arranged by hand by a user, and the appearance of the printing material also worsens.

In the recording apparatus disclosed in JP-A-5-155500, the stacker is provided to be liftable. The stacker is in a state of extending to the outside from a casing and being biased upward by a compression spring. Therefore, the stacker lowers under self weight as the medium load capacity increases. Therefore, it is easy to secure good alignment of a recording medium bundle on the stacker since it is possible to set the dropping distance to relatively shorten when the paper sheets drop from the discharge port to the receiving surface of the stacker or on an upper surface of the recording medium on the receiving surface.

In addition, a supply tray (one example of a mounting portion) in which it is possible to mount the medium before recording is provided in the recording apparatus described in JP-A-5-155500. The supply tray is an opening and closing type that is rotatable with respect to the casing of the recording apparatus, and the user is able to operate the apparatus in an accommodating state in which the supply tray is closed during non-use and a supply state in which the supply tray is open in order to mount (set) the medium.

However, in the recording apparatus described in JP-A-5-155500, although it is possible to secure the load capacity of the recording medium that is able to be loaded to be great by the stacker lowering, since the supply tray is positioned therebelow, the lower limit position is restricted to a position above the supply tray. Therefore, in order to increase the load capacity of the discharged recording medium, a contrivance is further required.

SUMMARY

An advantage of some aspects of the disclosure is to provide a recording apparatus that is able to increase the medium load capacity of a receiving portion in a configuration provided with a mounting portion and receiving portion.

Hereinafter, means of the disclosure and operation effects thereof will be described.

According to an aspect of the disclosure, there is provided a recording apparatus including a mounting portion that mounts a medium before recording, a recording portion that records on the medium that is supplied from the mounting portion, a discharge port that discharges the recorded medium, and a receiving portion that is disposed above the mounting portion and receives the medium that is discharged from the discharge port, wherein the mounting portion and the receiving portion overlap each other in the vertical direction, and the receiving portion moves while changing the distance in the vertical direction from the discharge port to the receiving portion, and moves to a position at which a second distance that is the distance when a second load height is higher than a first load height is longer than a first distance that is the distance when the load height of the received medium is the first load height, and a portion of the mounting portion has an entering clearance portion while the receiving portion lowers to a lower limit. Note that, in a case where the lower limit of the receiving portion is changed, there may be at least one lower limit at which it is possible to enter a portion of the mounting portion in the changed lower limit in the clearance portion.

According to this configuration, the mounting portion and the receiving portion overlap each other in the vertical direction. The receiving portion moves due to a change of distance in the vertical direction from the discharge port to the receiving portion. In this case, the receiving portion moves to a position at which the second distance when a second load height is higher than the first load height is longer than the first distance when the load height of the received medium is the first load height. In addition, the receiving portion and the mounting portion overlap each other in the horizontal direction due to a portion of the mounting portion entering the clearance portion while the receiving portion lowers to a lower limit. Consequently, it is possible to increase the medium load capacity of a receiving portion in a configuration provided with a mounting portion and a receiving portion.

In the recording apparatus, preferably, the mounting portion includes an edge guide that is able to position the mounted medium in a width direction, and at least a portion of the edge guide enters the clearance portion while the receiving portion lowers to a lower limit.

According to this configuration, the receiving portion and the mounting portion (edge guide) overlap each other in the horizontal direction due to at least a portion of the edge guide to which the mounting portion is provided entering the receiving portion of the clearance portion while the receiving portion moves to a lower limit. Therefore, it is possible to cause the receiving portion to lower to a position at which the receiving portion and the edge guide overlap each other in the horizontal direction. Consequently, it is possible to increase the medium load capacity of the receiving portion.

Preferably, the recording apparatus is further provided with a medium accommodating portion that accommodates the medium before the medium is supplied to the recording portion, wherein the medium accommodating portion, the mounting portion, and the receiving portion overlap each other in the vertical direction.

According to this configuration, since the medium accommodating portion, the mounting portion, and the receiving portion overlap each other in the vertical direction, it is possible to suppress the size to be small in a direction that intersects with the vertical direction of the recording apparatus, and the installation space of the recording apparatus is suppressed to be small.

Preferably, the recording apparatus is further provided with a movement mechanism that moves the receiving portion up and down and a control portion that controls the movement position of the receiving portion by driving the movement mechanism, wherein the control portion controls the position at which the receiving portion is caused to lower based on the medium load capacity on the receiving portion.

According to this configuration, since the movement position of the receiving portion is controlled according to the medium load capacity on the receiving portion, it is possible to cause the receiving portion to lower to an appropriate position according to the medium load capacity on the receiving portion. Consequently, a dropping distance of the medium from the discharge port is suppressed to be small within a predetermined range, and it is possible to load a medium bundle on the receiving portion to be better aligned.

Preferably, the recording apparatus is further provided with a detecting portion that detects the medium load capacity on the receiving portion, wherein the control portion controls the movement position of the receiving portion by maintaining the dropping distance up to the upper surface of the medium on the receiving portion at a set value or less according to the detection result of the detecting portion.

According to this configuration, since the dropping distance up to the upper surface of the medium on the receiving portion from the discharge port is maintained at a set value or less according to the detection result of the detecting portion, it is possible to suppress positional deviation of the medium to be small when falling on the receiving portion in comparison to a configuration of dropping a sufficiently long dropping distance at which the medium exceeds the set value. Consequently, it is possible to load the medium bundle on the receiving portion to be better aligned.

Preferably, the recording apparatus is further provided with a second detecting portion that detects the lower limit position of the receiving portion that is determined from the positional relationship between the receiving portion and the mounting portion or the medium on the mounting portion in a case where the detecting portion is a first detecting portion, wherein the control portion moves the receiving portion in a range of the lower limit position or more at which the second detecting portion is detected.

According to this configuration, the lower limit position of the receiving portion that is determined from the positional relationship between the receiving portion and the mounting portion or the medium on the mounting portion is detected by the second detecting portion. The receiving portion moves due to the control portion in a range of the lower limit position or more at which the second detecting portion is detected. That is, the lower limit when the receiving portion moves is limited to the lower limit position that is detected by the second detecting portion. Consequently, it is possible to avoid the lowered receiving portion interfering with the mounting portion or the medium on the mounting portion.

Preferably, in the recording apparatus, the second detecting portion detects the medium load capacity on the mounting portion, and the control portion moves the receiving portion in a range of the lower limit position or more according to the medium load capacity on the mounting portion that is detected by the second detecting portion.

According to this configuration, the receiving portion moves in a range of the lower limit position or more according to the medium load capacity on the mounting portion that is detected by the second detecting portion. Consequently, it is possible to cause the receiving portion to lower as far downward as possible while avoiding interference of the receiving portion and the medium on the mounting portion. Therefore, it is possible to greatly secure the medium load capacity on the receiving portion.

Preferably, the recording apparatus is further provided with a display portion, wherein the control portion causes the display portion to display instruction information to promote removal of the medium on the receiving portion when the medium load capacity that is detected by the detecting portion is load capacity in which discharge of the medium from the discharge port is prohibited in a state in which the receiving portion reaches the lower limit position.

According to this configuration, the receiving portion displays on the display portion instruction information to promote removal of the medium on the receiving portion in a case where the medium load capacity on the receiving portion is load capacity in which discharge of the medium from the discharge port is prohibited in a state in which the receiving portion reaches the lower limit position. Therefore, it is possible to promote removal of the medium from the receiving portion to the user. As a result, the recording apparatus is able to avoid leaving interrupted recording without change.

Preferably, the recording apparatus is further provided with a third detecting portion that detects the receiving portion that is the lowering limit position, wherein the control portion causes the receiving portion to lower until the third detecting portion detects the receiving portion when there is no medium on the mounting portion and the lowering limit position of the receiving portion is set.

According to this configuration, it is possible to perform origin setting and the like of the receiving portion and set the lowering limit position by causing the receiving portion to lower when there is no medium on the mounting portion and the lowering limit position of the receiving portion is detected in the third detecting portion. For example, accurate measurement of the movement position of the receiving portion is possible in a case where the movement position of the receiving portion is measured with the detected lowering limit position as the origin. Therefore, it is possible to increase precision of the position control of the receiving portion.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Figure 1:
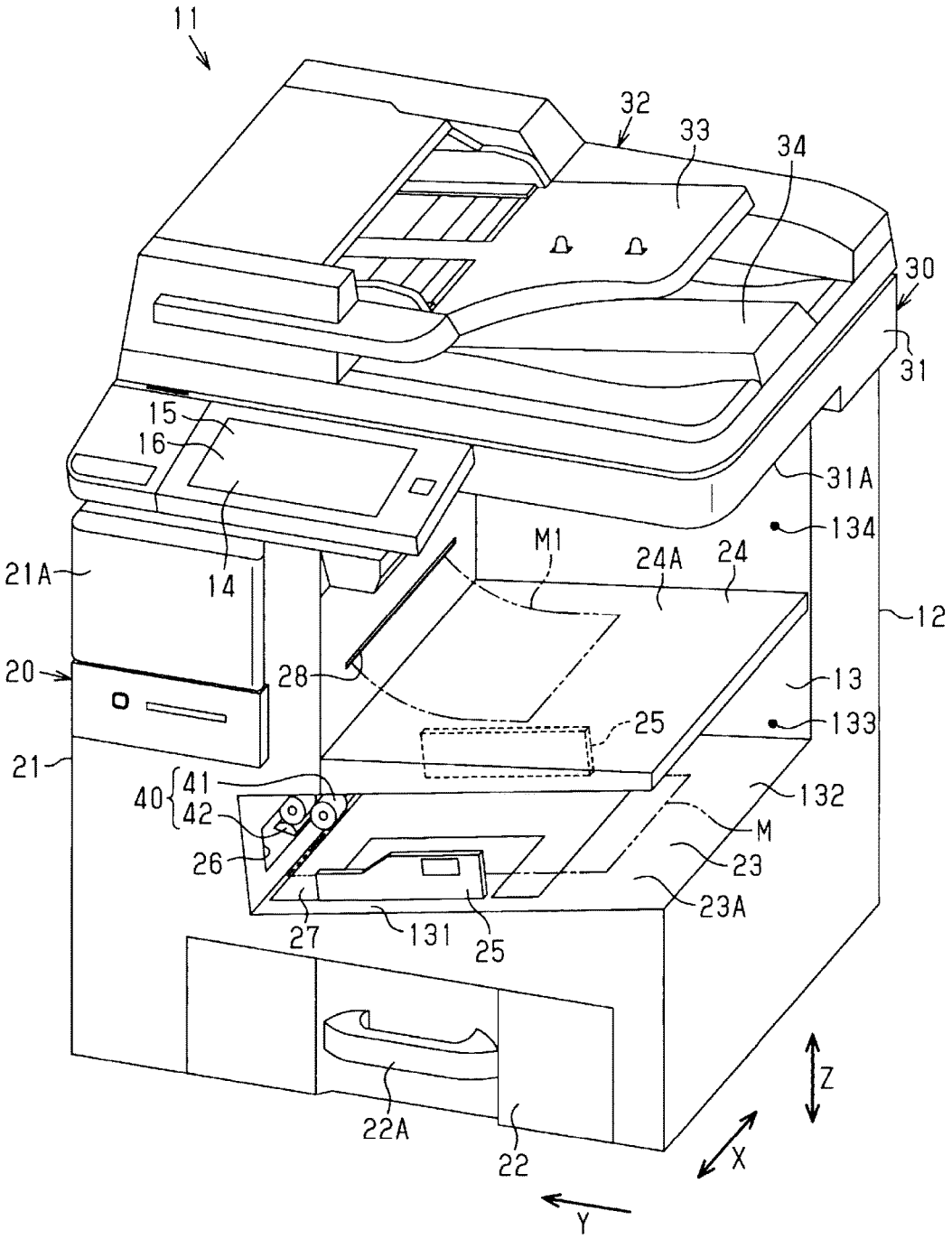
FIG. 1 is a schematic perspective view of a recording apparatus that consists of a multifunction printer in one embodiment.

An embodiment of a recording apparatus will be described below with reference to the drawings. A recording apparatus 11 of the present embodiment that is indicated in FIG. 1 is a multifunction printer that is provided with a scanner function, a copy function, and the like in addition to a printing function. As shown in FIG. 1, the recording apparatus 11 is provided with a printing apparatus 20 that performs recording (printing) on a medium M and an image reading apparatus 30 (scanner) that performs reading (scanning) of a document and the like. The recording apparatus 11 is configured such that the printing apparatus 20 and the image reading apparatus 30 are mounted to be stacked in a vertical direction Z. That is, the image reading apparatus 30 is disposed on an upper portion of the printing apparatus 20. The recording apparatus 11 is provided with a casing 12 that has a main body 31 of the image reading apparatus 30 on the upper portion.

The casing 12 has a concave portion 13 that is open to two surfaces of a front surface on a front side and a side surface on a right side in FIG. 1. The concave portion 13 has a first opening 131 that opens to the front surface side of the casing 12 and a second opening 132 that is open at one (right side in the example in FIG. 1) side surface side of the casing 12. The concave portion 13 is blocked at a part at the back facing the first opening 131 on the front surface side and is blocked at a part facing the second opening 132 on the right side surface side by a square columnar printing function portion 21. In addition, an upper side inner wall surface of the concave portion 13 is configured by a portion of a bottom surface of the approximately square plate shape main body 31 that configures the image reading apparatus 30. That is, the upper part of the concave portion 13 is covered by a portion of the main body 31. Note that, hereinafter, the main body 31 is also referred to as a "scanner main body 31".

Furthermore, a part of the inner bottom surface of the concave portion 13 is a supply tray 23 as an example of a mounting portion on which it is possible to mount the supplied medium M before printing. In addition, a stacker 24 (discharge stacker) is provided in the concave portion 13 as an example of a receiving portion that receives the medium (hereinafter also referred to as a "recording medium M1") that is discharged from the discharge port 28 which has the casing 12 in the concave portion 13 after recording (printing). The stacker 24 is disposed above the supply tray 23. The user is able to access placing (setting) of the medium M, taking out of the recording medium M1, and the like by inserting a hand into the concave portion 13 via at least one of the openings 131 and 132.

As shown in FIG. 1, the image reading apparatus 30 is provided with an automatic feeding device 32 that automatically feeds documents to the upper side of the scanner main body 31. In addition, the image reading apparatus 30 is provided with a reading portion (not shown) that reads an image of a character, photo, and the like that is recorded on a document that is fed by the automatic feeding device 32. The automatic feeding device 32 has a tray 33 on which it is possible to mount the document in a stacked state, and the documents that are mounted on the tray 33 are fed one sheet at a time. The image reading apparatus 30 reads the document that is fed from the tray 33 by the reading portion, and after reading, the document is discharged to a discharge portion 34 that is provided on the lower side of the tray 33. The automatic feeding device 32 is rotatable with respect to the scanner main body 31 and the lower portion of the automatic feeding device 32 serves as a document table cover of the image reading apparatus 30. The automatic feeding device 32 rotates from the closed state to the open state that is indicated in FIG. 1 to expose the document mounting surface (glass surface), not illustrated, which the upper surface of the main body 31 acts as. Note that, the main body 31 is configured, for example, by a configuration component that includes a reading portion that reads the document and a movement mechanism that moves the reading portion in a scanning direction, and a housing portion that accommodates the configuration components and forms a document table with the upper surface portion by assembling on an upper portion a glass plate on which the document is mounted.

An operation panel 14, which is used in various operations for giving instructions to the recording apparatus 11, is provided on the front side of the image reading apparatus 30 in the recording apparatus 11. The operation panel 14 is provided with an operation portion 15 and a display portion 16. In the present example, the display portion 16 is, for example, configured by a touch panel and the operation portion 15 is configured by a touch operation input function of a touch panel. Note that, the operation portion 15 may be configured by an operation switch or the like.

The printing apparatus 20 has the square columnar printing function portion 21 on a part next to (next to on the left) the concave portion 13 in the casing 12. A cassette 22, which is an example of a medium accommodating portion that is able to accommodate the medium M such as a plurality paper sheets in a stacked state, is inserted in a part (lower portion) that is the lower side of the printing function portion 21 and the concave portion 13 in the casing 12. The concave portion 13 is positioned on the upper side of the cassette 22 in the vertical direction Z. The cassette 22 has a grasping portion 22A on the front surface of the cassette 22. The user uses the grasping portion 22A to be able to attach and detach the cassette 22 to and from the casing 12. In addition, a cover 21A, which opens and closes when an ink accommodating portion 59 (refer to FIG. 3), that will be described later, is provided on a lower side of the operation panel 14 in the printing function portion 21. Note that, the recording apparatus 11 is able to extend one or a plurality of cassettes 22 on the lower side of the cassette 22.

In the recording apparatus 11, one side surface on the side at which the operation panel 14 out of four side surfaces is disposed is a front surface. In addition, in the recording apparatus 11, one side surface on the side at which one part, that includes the grasping portion 22A of the cassette 22 which is accommodated in the casing 12 out of four side surfaces, is exposed is a front surface. In FIG. 1, the surface on the front side of the recording apparatus 11 is the front surface.

Figure 2:
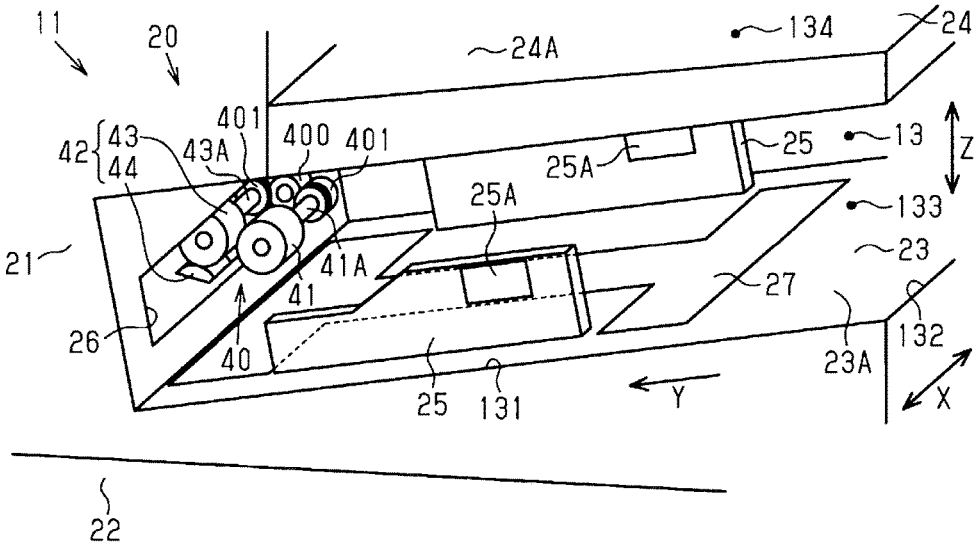
FIG. 2 is a schematic perspective view illustrating a peripheral part of a supply tray.

In addition, as shown in FIGS. 1 and 2, the part that is equivalent to the bottom portion of the concave portion 13 in the casing 12 is the supply tray 23 (tray portion) on which it is possible to mount (set) the medium M in the concave portion 13 before printing. The supply tray 23 has a mounting surface 23A on which it is possible to mount a plurality of sheets of the medium M to be supplied in a stacked state, one side (front side) in a direction (depth direction) that intersects (for example, is orthogonal to) a supply direction of the medium M on the mounting surface 23A is opened by the first opening 131, and an upstream side in the supply direction of the medium M on the mounting surface 23A is opened by the second opening 132. Therefore, the user is able to mount the medium M on the mounting surface 23A of the supply tray 23 that is positioned on the bottom surface of the concave portion 13 via the openings 131 and 132. The supply tray 23 is fixed at an oblique posture to the part on the upper side of the cassette 22 in the casing 12. That is, in the supply tray 23, the mounting surface 23A on which the medium M before printing is set has an inclined posture that is inclined at an orientation in which a position shortens in the vertical direction Z toward a tip end side (downstream end side) (left side in FIG. 1) in a feeding direction Y of the medium M that is mounted on the mounting surface 23A. Note that, hereinafter, the supply direction in which the medium M on the mounting surface 23A is supplied is referred to as the feeding direction Y (left direction in FIGS. 1 and 2), and a direction that intersects with (for example, is orthogonal to) the feeding direction Y is referred to as a width direction X.

Figure 3:
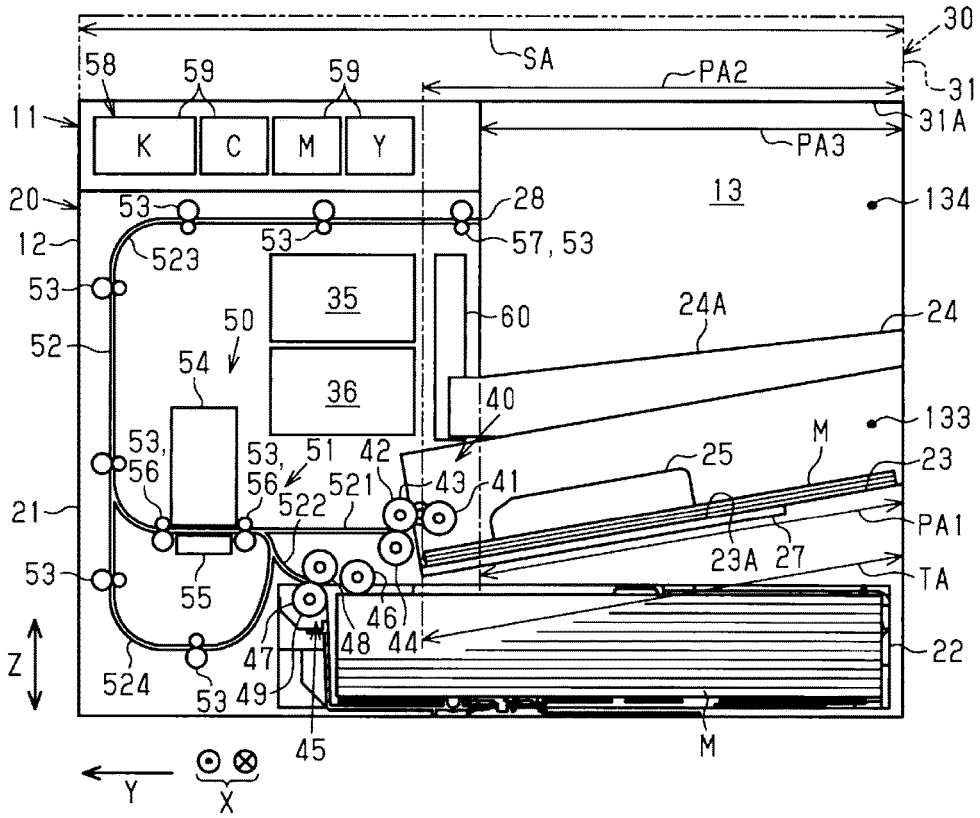
FIG. 3 is a schematic side sectional view illustrating the recording apparatus.

In addition, as shown in FIG. 1, the stacker 24 that receives the recording medium M1 that is a medium M after printing (after recording) is disposed at a position above the supply tray 23 in the concave portion 13. The stacker 24 in the example is provided to be movable (liftable) in the concave portion 13 in the vertical direction Z along the side surface (right side surface in FIG. 1) of the printing function portion 21. As shown in FIG. 3, a motorized type movement mechanism 60 that moves the stacker 24 in the vertical direction Z is provided in the casing 12. The stacker 24 is driven by the movement mechanism 60 to move up and down. The concave portion 13 is partitioned into a first space 133 and a second space 134 in the vertical direction Z by the stacker 24 that is movable up and down. The first space 133 is used as a loading space in which the supplied medium M is loaded on the supply tray 23, and the second space 134 is used as a loading space in which the recording medium M1 that is discharged from the discharge port 28 is loaded on the stacker 24.

As shown in FIGS. 1 and 3, the supply tray 23 and the stacker 24 overlap each other in the vertical direction Z. In the example, the supply tray 23 and the stacker 24 are positioned such that at least a portion overlap each other in the vertical direction Z in the concave portion 13. In addition, the cassette 22, the supply tray 23, and the stacker 24 overlap each other in the vertical direction Z. Furthermore, the supply tray 23, the stacker 24, and the main body 31 of the image reading apparatus 30 overlap each other in the vertical direction Z.

As shown in FIG. 3, when the recording apparatus 11 is viewed horizontally from the front surface, in the supply tray 23 and the stacker 24, a projection area PA1 of the receiving surface 24A has a positional relationship so as to be contained in the mounting surface 23A of the supply tray 23 (that is, a disposal region TA of the mounting surface 23A) in a case where the receiving surface 24A of the stacker 24 is projected in the vertical direction Z with respect to the mounting surface 23A of the supply tray 23. That is, when the recording apparatus 11 is viewed horizontally from the front surface, in the supply tray 23 and the stacker 24, the projection area PA1 of the receiving surface 24A has a positional relationship so as to be contained in the disposal region TA of the mounting surface 23A and overlap each other in the vertical direction Z.

In addition, as shown in FIGS. 1 and 3, the bottom surface 31A of the scanner main body 31 forms a ceiling surface (upper side inner wall surface) of the concave portion 13. Then, the main body 31, the supply tray 23, and the stacker 24 overlap each other in the vertical direction Z. As shown in FIG. 3, a projection region of the mounting surface 23A is set as PA2 in a case where the mounting surface 23A of the supply tray 23 is projected in the vertical direction Z with respect to the bottom surface 31A of the scanner main body 31 (virtual plane that includes the bottom surface 31A). When the recording apparatus 11 is viewed horizontally from the front surface, in the supply tray 23 and the scanner main body 31, the projection area PA2 of the mounting surface 23A has a positional relationship so as to be contained in bottom surface 31A of the scanner main body 31 (that is, disposal region SA of the bottom surface 31A). That is, when the recording apparatus 11 is viewed horizontally from the front surface, in the supply tray 23 and the scanner main body 31, the projection area PA2 of the mounting surface 23A has a positional relationship so as to be contained in bottom surface 31A of the scanner main body 31 (that is, disposal region SA) and overlap each other in the vertical direction Z. In addition, when the recording apparatus 11 is viewed horizontally from the front surface, the projection region of the receiving surface 24A is set as PA3 in a case where the receiving surface 24A of the stacker 24 is projected in the vertical direction Z with respect to the bottom surface 31A of the scanner main body 31. When the recording apparatus 11 is viewed horizontally from the front surface, in the supply tray 23, the stacker 24, and the scanner main body 31, the disposal region SA of the bottom surface 31A has a positional relationship so as to be contained in either of the projection region PA2 of the mounting surface 23A and the projection region PA3 of the receiving surface 24A overlap each other in the vertical direction Z. Furthermore, when the recording apparatus 11 is viewed horizontally from the front surface, in the cassette 22 and the scanner main body 31, the projection area (not shown) of the cassette 22 has a positional relationship so as to be contained in bottom surface 31A (that is, disposal region SA of the bottom surface 31A) and overlap each other in the vertical direction Z in a case where the cassette 22 is projected in the vertical direction Z with respect to the bottom surface 31A of the scanner main body 31.

In the example that is indicated in FIG. 1, the supply tray 23 and the stacker 24 are wholly disposed in the concave portion 13, and the proportion of overlap amounts of one of the supply tray 23 and the stacker 24 with respect to the other that overlap each other in the vertical direction Z is 80% or more. In detail, when projecting from one of the supply tray 23 and the stacker 24 to the other in the vertical direction Z, for example, the dimension proportion that occupies one projection part with respect to the other is 80% or more of a length in the supply direction Y.

In addition, the supply tray 23 and the stacker 24 do not protrude from the first opening 131 on the front surface side with respect to the casing 12 or from the second opening 132 on the right side surface side to the outside (right side in FIG. 1). That is, the supply tray 23 and the stacker 24 fit in the concave portion 13 regardless of use or non-use, and do not protrude from the front surface and the side surface of the casing 12 to the outside. Therefore, an installation space of the recording apparatus 11 is suppressed to be relatively small.

As shown in FIGS. 1 and 3, the supply tray 23 is disposed with a posture that is inclined obliquely such that the downstream end side in the supply direction Y of the medium M on the mounting surface 23A is further to the lower side in a direction of gravity (vertical direction Z) than the upstream end side. Consequently, the medium M when mounted on the supply tray 23 is aligned in a state in which the front end is aligned by the medium M moving to the feeding direction Y side under self-weight and the front end of the medium M abutting against a wall surface of the printing function portion 21. Therefore, the rear end edge guide is unnecessary since the rear end of the medium M is guided in the feeding direction Y. In addition, it is possible to relatively shorten the length dimension in the feeding direction Y that is necessary for the supply tray 23 in order for the medium M of a predetermined length to be mountable on the mounting surface 23A by giving the supply tray 23 an inclined posture in comparison to a case where the posture is not inclined (for example, horizontal posture). That is, it is possible to shorten the length dimension of the supply tray 23 in the feeding direction Y for the length of the medium M that is to be mounted. In addition, the rear end portion of the medium M need not stick out from the concave portion 13 to the outside in a case where a comparatively long medium M is mounted on the supply tray 23 by inclining the posture of the supply tray 23. Therefore, even if the medium M is mounted on the supply tray 23 without change, dust tends not to accumulate on the medium M.

As shown in FIGS. 1 and 3, the stacker 24 is disposed with a posture that is inclined obliquely such that the upstream end side in a discharge direction −Y of the medium M1 on the receiving surface 24A is further to the lower side in the direction of gravity (vertical direction Z) than the downstream end side and the upper surface of the stacker 24 is the receiving surface 24A that receives the medium M1 after recording. That is, the supply tray 23 and the stacker 24 are inclined with the same orientation. The medium M1 when discharged on the stacker 24 is aligned in a state in which the rear end is aligned on the receiving surface 24A by the medium M1 moving to the opposite side from the discharge direction −Y under self-weight and the rear end of the medium M1 abutting against a wall surface of the printing function portion 21. Therefore, the front end edge guide is unnecessary since the front end of the medium M1 in the discharge direction −Y is guided. In addition, it is possible to relatively shorten the length dimension in the discharge direction −Y that is necessary for the stacker 24 in order for the medium M1 of a predetermined length to be mountable on the receiving surface 24A by giving the stacker 24 an inclined posture in comparison to a case where the posture is not inclined (for example, a case of horizontal posture). Therefore, it is possible to shorten the length dimension of the stacker 24 in the discharge direction −Y for the length of the medium M1 that is able to be received by the stacker 24. Note that, the discharge direction −Y is a direction on an opposite side from the feeding direction Y.

In a case where a maximum size of the medium M that is assumed for the recording apparatus 11 is, for example, A4, the A4 medium M on the supply tray 23 is loaded without sticking out from the side surface of the casing 12, and the A4 recording medium M1 on the stacker 24 is loaded without sticking out from the side surface of the casing 12. In addition, in a case where a maximum size of the medium M that is assumed for the recording apparatus 11 is, for example, A3, the A3 medium M on the supply tray 23 is loaded without sticking out from the side surface of the casing 12, and the A3 medium M on the stacker 24 is loaded without sticking out from the side surface of the casing 12.

As shown in FIG. 1, the supply tray 23 has a pair of edge guides 25 that guide the medium M on the mounting surface 23A in the width direction X. The pair of edge guides 25 are operated by a user when the medium M that is mounted on the mounting surface 23A is positioned in the width direction X. The pair of edge guides 25 protrude upward from the mounting surface 23A and are configured to be movable in conjunction with the medium M in the width direction X. The pair of edge guides 25 in the embodiment adopt a positionable center feeding method for moving in conjunction with a symmetrical position in the width direction X with respect to a width center line of the medium M on the supply tray 23, and guiding the width center of the medium M to a position that matches the width center of a feeding port 26. Note that, the pair of edge guides 25 may be configured such that one edge guide is fixed and the other edge guide is movable in place of the configuration of the center feeding method, and may be configured such that the medium M is positioned flush to one end in the width direction X by moving the other edge guide with reference to the fixed side edge guide.

As shown in FIG. 1, the feeding port 26 for supplying the medium M on the supply tray 23 is open to the side surface (right side surface) facing the concave portion 13 of the printing function portion 21. The supply tray 23 is disposed to be positioned below the feeding port 26. The supply tray 23 has a plate shape hopper 27 that is able to press up the medium M that is set on the mounting surface 23A. The hopper 27 has an approximately H-shape plate member as indicated in FIG. 1, and the downstream side part is movable up and down centered on a rotary shaft 27A (refer to FIGS. 15 and 16) that is positioned on one end of the upstream side in the feeding direction Y. The hopper 27 is biased upward by a biasing force (elastic force) of a spring 29 (refer to FIG. 15), and moves up and down between a standby position that is indicated in FIG. 2 and a supply position (lifting position) that is indicated in FIGS. 15 and 16 via a feeding motor 84 (refer to FIG. 8) or a lifting mechanism, not illustrated, by motive force of a dedicated electric motor.

As shown in FIGS. 1 and 2, a first feeding portion 40 that feeds the medium M on the supply tray 23 from the feeding port 26 to inside the printing function portion 21 is provided at a position in the vicinity of the feeding port 26 inside the casing 12. The first feeding portion 40 has the hopper 27, a pickup roller 41 that is positioned above the downstream side end portion of the hopper 27 in the feeding direction Y, and a separation mechanism 42 that is positioned adjacent to the downstream side in the feeding direction Y with respect to the pickup roller 41. In the example that is indicated in FIG. 2, the separation mechanism 42 has a feeding roller 43 and a separation roller 44 (retard roller). As shown in FIG. 3, in the feeding direction Y, the pickup roller 41 that feeds the medium M on the supply tray 23 is positioned further on the downstream side than the discharge port 28. That is, in a case where the recording apparatus 11 is viewed vertically, out of the pickup roller 41 and the discharge port 28, the one of the pickup roller 41 is close to the recording portion 54. Note that, in place of the roller separation method described above, there may be a bank separation method in which the separation mechanism is provided with a separation portion (bank portion) that has a friction surface with an erect inclined shape at a predetermined inclination angle with respect to the feeding direction, and one sheet of the medium M that is to be fed is separated from another sheet of the medium by feeding the medium M along the friction surface with an inclined shape.

Figure 15:
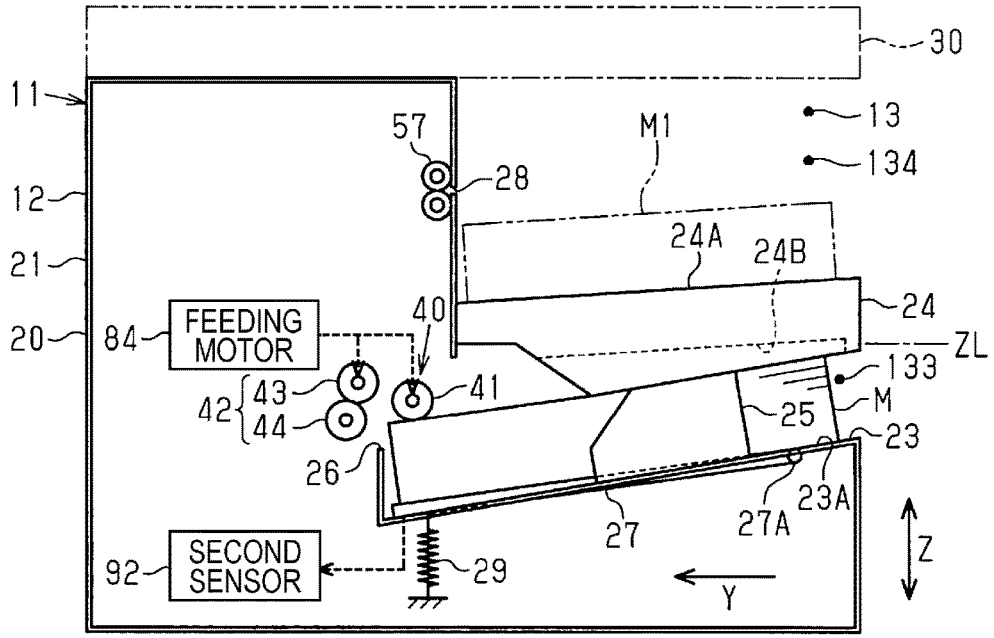
FIG. 15 is a schematic side sectional view illustrating a lower limit position of the stacker when there is a medium in the supply tray.
Figure 16:
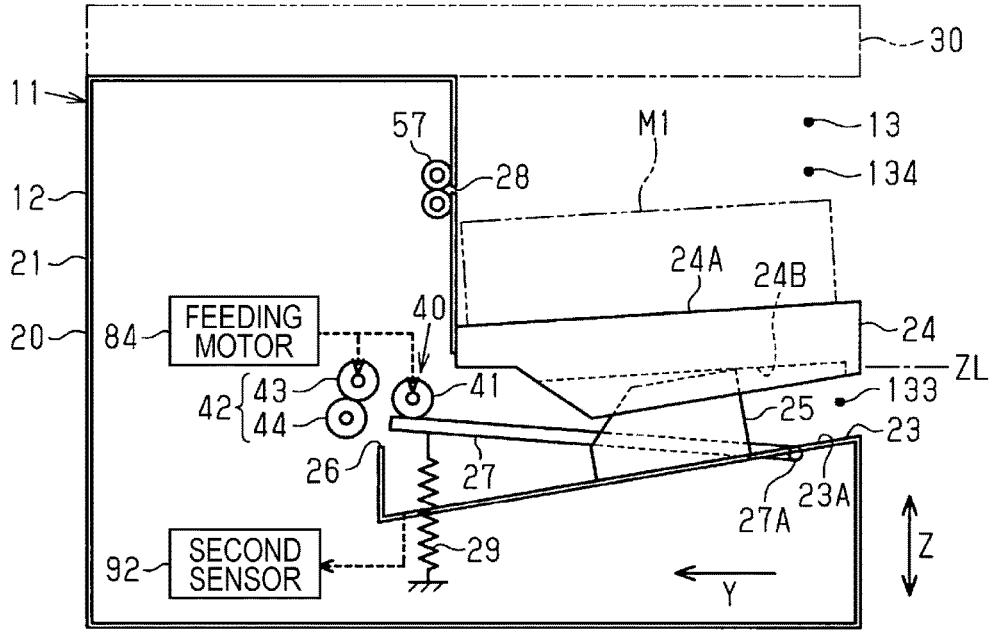
FIG. 16 is a schematic side sectional view illustrating a lower limit position of the stacker when there is no medium in the supply tray.

When the holding mechanism is released by motive force of an electric power source, the hopper 27 that is indicated in FIGS. 2 and 15 is lifted by biasing force of a spring 29 (FIG. 15) from the standby position, and returns to the standby position that is indicated in FIG. 2 lowering from the supply position that is indicated in FIGS. 15 and 16 at which the medium M on the supply tray 23 is pressed against the pickup roller 41 and the supply position against the biasing force of the spring 29 by motive force of the power source. When starting printing, the hopper 27 is lifted, the medium M on the supply tray 23 presses against the pickup roller 41 from the lower side, and in that state, one sheet of the medium M on the top on the supply tray 23 is fed by the pickup roller 41 rotationally driving. Even if it is assumed that a plurality of sheets of the medium M that are fed out by the pickup roller 41 are fed (multiply fed), the sheets are separated into single sheets by utilizing differences of frictional force between two rollers 43 and 44 that configure the separation mechanism 42.

As shown in FIG. 2, the pickup roller 41 and the feeding roller 43 are linked in a state in which it is possible to transmit motive force to the feeding motor 84 which, will be described later (refer to FIGS. 15 and 16), via a motive force transmission mechanism 400 that includes each gear 401 that are respectively provided in revolving shafts 41A and 43A. In addition, an operation portion 25A is provided on the upper end portion of the edge guide 25, the edge guide 25 is locked at the position when a pressing operation of the operation portion 25A stops due to movement of the edge guide 25 being possible in the width direction X when operating the operation portion 25A by pressing.

As shown in FIG. 1, on the side surface (right side surface) facing the concave portion 13 of the printing function portion 21, the discharge port 28 for discharging the recording medium M1 after printing is open to a position (position on an upper side in the example in FIG. 1) that is different from that of the feeding port 26 in the vertical direction Z. The stacker 24 moves up and down in a range of the uppermost upper limit position out of positions at which it is possible to receive the recording medium M1 that is discharged from the discharge port 28 and a lower limit position at which the supply tray 23 that is disposed at a lower side thereof or the medium M on the supply tray 23 is not interfered with. In the stacker 24, the position that is set below the lifting limit position by a predetermined margin distance is set as the upper limit position. The upper limit position of the stacker 24 in the example is a position slightly below a position (in detail, a nip position of the discharge roller 57 in FIG. 3 which, will be described later) of the discharge port 28 by a distance (for example, a predetermined value within a range of 1 to 50 mm).

Then, the stacker 24 moves in the vertical direction Z while maintaining a dropping distance Zd (refer to FIG. 7) that is a distance in the vertical direction Z from the discharge port 28 (nip position of the discharge roller 57) up to the receiving surface 24A or the uppermost surface of the recording medium M1 on the receiving surface 24A so as to fit within a predetermined range that satisfies a condition of being a set distance Zf or less. For example, the stacker 24 is lowered according to the load capacity of the recording medium M1 on the receiving surface 24A. In addition, the lower limit position of the stacker 24 changes according to the supply tray 23 that is positioned below the stacker 24 or the load capacity of the medium M on the supply tray 23. In detail, in a case where the medium M on the supply tray 23 is a specific load capacity or more, the stacker 24 is positioned above the position to abut the uppermost surface of the medium M on the supply tray 23 by a predetermined margin distance and the position is set as a lower limit position (FIG. 15). In addition, in a case where there is no medium M on the supply tray 23 and in a case where the medium M on the supply tray 23 is less than a specified load capacity, the stacker 24 is positioned above the position to abut the edge guide 25 by a predetermined margin distance (for example, a predetermined value within the range of 0 to 10 mm) and the position is set as a lower limit position (FIG. 16).

As shown in FIG. 3, a second feeding portion 45 that feeds a plurality of sheets of the medium M that is accommodated in the cassette 22 in order one sheet at a time from the uppermost position is disposed at an upper position in the vicinity of the downstream side end portion of the cassette 22 in the feeding direction Y. In the same manner as the first feeding portion 40, the second feeding portion 45 has the pickup roller 46 that feeds the medium M and the separation mechanism 47 that is positioned adjacent to the feeding direction Y of the pickup roller 46. In the example that is indicated in FIG. 3, in the roller separation method, the separation mechanism 47 has the feeding roller 48 and the separation roller 49 (retard roller). Note that, the separation mechanism 47 may use the bank separation method.

The medium M in the cassette 22 that is accommodated in the casing 12 is biased to the upper side in the vertical direction Z, and is pressed against the pickup roller 46. When starting printing, the medium M in the cassette 22 is fed one sheet at a time in order from the uppermost position when the pickup roller 46 and the feeding roller 48 are rotatably driven by motive force of the power source of the second feeding portion 45. The medium M that is fed out by the pickup roller 46 is separated into single sheets by utilizing frictional force by two rollers 48 and 49 that configure the separation mechanism 47, and is fed to the printing function portion 21. Note that, the power source of the two feeding portions 40 and 45 is a feeding motor 84 dedicated to feeding (refer to FIG. 8), but in place thereof, a transport motor 85 (refer to FIG. 8) is utilized that is a power source of a transport portion 51 which will be described later, and the transport portion 51 and the feeding portions 40 and 45 may be configured to share the power source.

As shown in FIG. 3, the printing machine 50 that performs transport of the supplied medium M and printing on the medium M is accommodated in the printing function portion 21. The transport portion 51 is provided that transports the medium M that is fed from the cassette 22 and the supply tray 23 along a transport passage 52, that is indicated by a dashed line in FIG. 3, from the feeding port 26 up to the discharge port 28 that is positioned on the downstream end of the path. The transport portion 51 has a plurality of pairs of rollers 53.

The recording portion 54 that faces the transport passage 52 is provided at a position on the transport passage 52. The recording portion 54 has a line head that is able to discharge ink across the width direction X of the medium M. Note that, the recording portion 54 is not limited to a line recording method in which recording of the width of one line is performed once using a line head, and a serial recording method may be used for providing a recording head in a carriage that is movable in the width direction X and discharging ink from the recording head to perform recording of the width of one line by the movement process of the carriage. In addition, the position and disposition angle of the recording portion 54 is not limited to the example in FIG. 3 and may be modified, as appropriate.

A support base 55 that supports the medium M is disposed at a position on the opposite side from the recording portion 54 and interposing the transport passage 52. The support base 55 holds the medium M at a position separated by a predetermined gap with respect to the recording portion 54. The plurality of pairs of rollers 53 that configure the transport portion 51 are positioned on both sides (upstream side and downstream side) to interpose the recording portion 54 in the transport direction Y, and a set of pairs of transport rollers 56 are included that transport the medium M during recording that is held on the support base 55. In addition, a pair of discharge rollers 57 that discharge the recording medium M1 from the discharge port 28 are included in the plurality of pairs of rollers 53. In addition, in the example that is indicated in FIG. 3, the feeding direction Y of the medium M using each feeding portion 40 and 45 and the transport direction of a part that faces the recording portion 54 out of the medium M that is transported on the support base 55 are the same. Therefore, in the embodiment, the transport direction of the medium M in the recording process by the recording portion 54 may be indicated by referring to the "transport direction Y".

The transport passage 52 has a supply passage 521 that feeds the medium M from the supply tray 23 up to a recording position that faces the recording portion 54, and a supply passage 522 that feeds the medium M from the cassette 22 up to a recording position that faces the recording portion 54. In addition, the transport passage 52 has an inversion transport passage 523 that is an example of an inversion transport passage that inverts the recording medium M1 after recording by the recording portion 54 and transports the recording medium M1 toward the discharge port 28. Furthermore, the transport passage 52 includes an inversion passage 524 that is a passage that transports in reverse the medium M on which single side recording is complete in a case of both surface recording, inverts the medium M, returns the medium M to the upstream side of the recording portion 54 again, and feeds the medium M again to the recording portion 54. Note that, the transport portion 51 may include, for example, a transport belt that transports the medium M during printing. In this case, preferably, the transport belt is configured to go around in a state of holding the medium M on the outer peripheral surface by electrostatic adsorption.

As shown in FIG. 3, the first feeding portion 40 for the supply tray 23 and the second feeding portion 45 for the cassette 22 are disposed so as to be positionally shifted in the feeding direction Y. Then, the first feeding portion 40 and the second feeding portion 45 are respectively disposed with a portion of each being the same height in the vertical direction Z. In the example that is indicated in FIG. 3, the separation roller 44 that configures the first feeding portion 40 and the feeding roller 48 that configures the second feeding portion 45 are disposed such that respective portions are positioned at the same height in the vertical direction Z. Therefore, it is possible for the disposition positions of the cassette 22 and the supply tray 23 to be close in the vertical direction Z, and the height of the recording apparatus 11 is suppressed to be relatively low.

As shown in FIG. 3, an ink accommodating unit 58 is provided at a position between the inversion transport passage 523 in the casing 12 and the image reading apparatus 30. A plurality (four in the example in FIG. 3) of ink accommodating portions 59 (for example, an ink cartridge or ink tank) in which ink is accommodated are attached to the ink accommodating unit 58 in a state of being attachable and detachable. The plurality of ink accommodating portions 59 accommodate ink of respective different colors. Different colors of ink that include, for example, black (K), cyan (C), magenta (M), and yellow (Y) are accommodated one color at a time in respective ink accommodating portions 59. In the example in FIG. 3, four ink accommodating portions 59 that correspond to four colors (KCMY) are illustrated, but for example, the ink accommodating portion 59 may be added that correspond to other colors such as light cyan, light magenta, light yellow, gray, green, and violet.

As shown in FIG. 3, an ink supply portion 35 and a maintenance device 36 are disposed lined up in the vertical direction Z in a region that is on the inner side of the passage on which the recording medium M1 is inverted and transported up to the discharge port 28 after recording (printing) is performed on the medium M that is supplied from the feeding port 26 out of the transport passage 52 in the casing 12. The ink supply portion 35 supplies ink from each ink accommodating portion 59 to the recording portion 54 and is interjacent on an ink tube, not illustrated, that connects each ink accommodating portion 59 and the recording portion 54. The recording portion 54 records on the medium M by discharging ink of each color supplied through an ink tube, not illustrated, from each ink accommodating portion 59 by the ink supply portion 35. The maintenance device 36 performs maintenance such as cleaning of a nozzle with the object of preventing clogging and the like of a nozzle that the recording portion 54 has in order to discharge ink.

Figure 4:
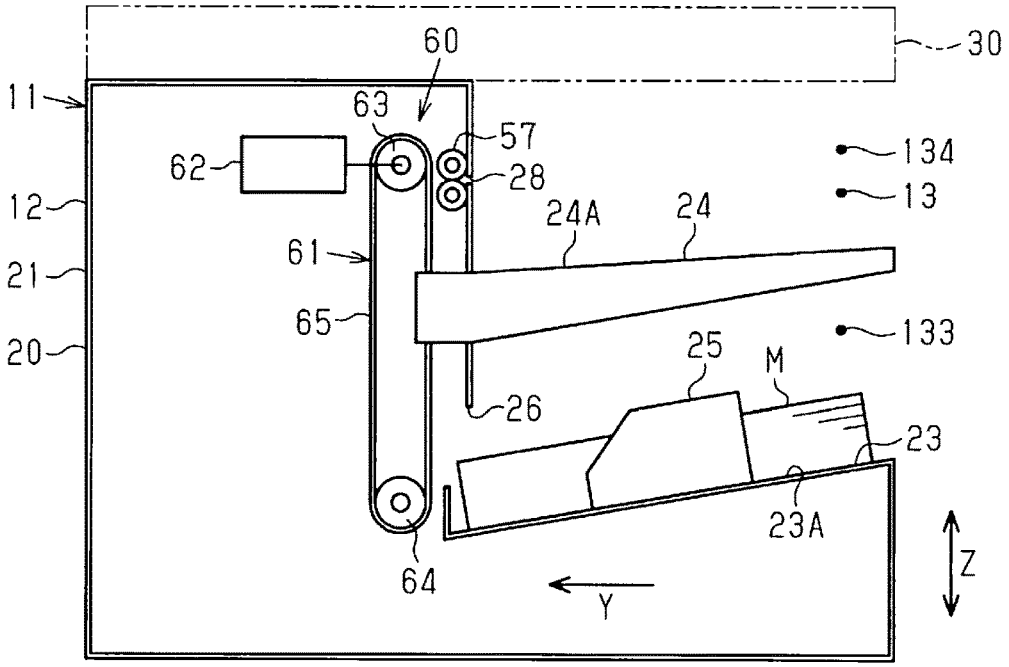
FIG. 4 is a schematic side sectional view illustrating a movement mechanism of a stacker in the recording apparatus.
Figure 5:
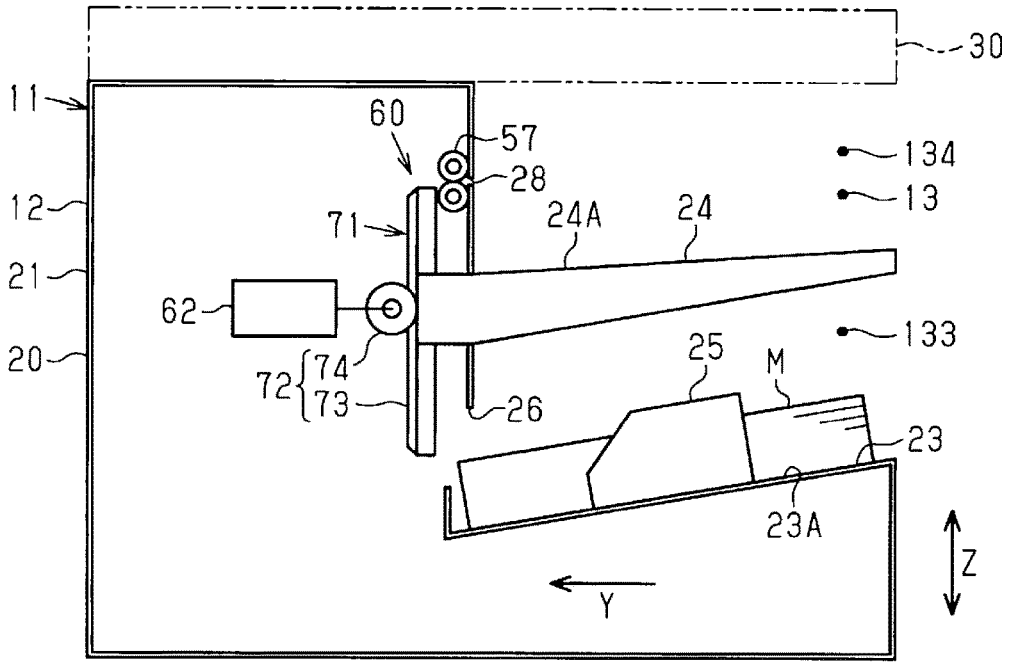
FIG. 5 is a schematic side sectional view illustrating a movement mechanism different from that in FIG. 4 of a stacker in the recording apparatus.

Next, referring to FIGS. 4 and 5, a movement mechanism (lifting mechanism) that moves the stacker 24 up and down will be described. Note that, in FIGS. 4 and 5, the configuration of a portion of the printing machine 50, the cassette 22, and the like in the printing function portion 21 is omitted. As the movement mechanism 60 that moves the stacker 24 up and down, for example, a belt-driving method that is indicated in FIG. 4, a gear-driving method that is indicated in FIG. 5, and the like are given. The movement mechanism 60 that is indicated in FIG. 4 is provided with a belt-type driving mechanism 61 and an electric motor 62 that is a power source. The belt-type driving mechanism 61 is provided with a pair of pulleys 63 and 64 that branch separated by a predetermined distance in the vertical direction Z, and a timing belt 65 that is wound on both pulleys 63 and 64. A base portion of the stacker 24 is connected to a portion of the timing belt 65. The stacker 24 moves up and down via the belt-type driving mechanism 61 by driving the electric motor 62 forward and in reverse.

The movement mechanism 60 that is indicated in FIG. 5 is provided with a gear driving mechanism 71 and an electric motor 62 that is a power source. The gear driving mechanism 71 includes, for example, a rack and pinion 72. A rack 73 that configures the rack and pinion 72 is disposed with an orientation in which a longitudinal direction is parallel to the vertical direction Z, and the base portion of the stacker 24 is fixed to the position along the longitudinal direction. The pinion 74 that is rotatable due to rotation of an output shaft of the electric motor 62 meshes with the rack 73. The stacker 24 moves up and down along with the rack 73 by rotating the pinion 74 forward and in reverse by driving of the electric motor 62. Then, a control portion 80 (refer to FIG. 8), which will be described later, positionally controls a movement position of the stacker 24 by driving the movement mechanism 60 based on the load capacity of the recording medium M1 on the stacker 24.

Figure 6:
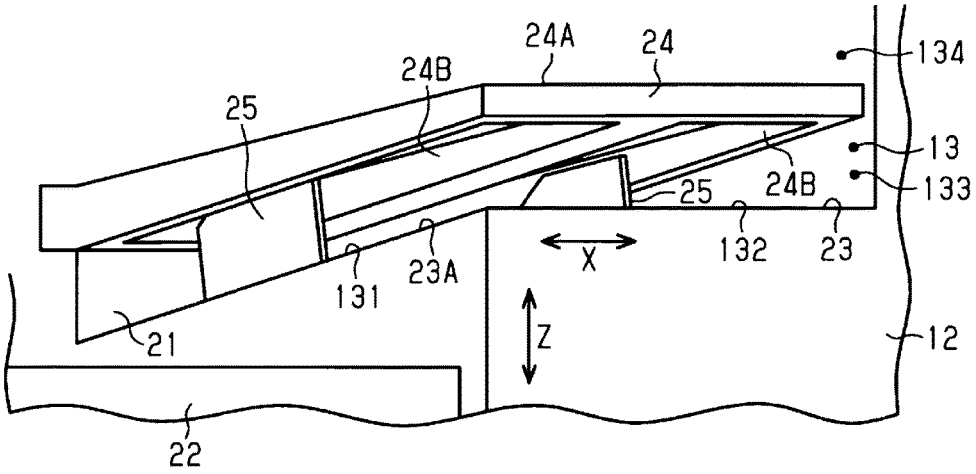
FIG. 6 is a perspective view illustrating the supply tray and the stacker.

As shown in FIG. 6, a clearance portion 24B for clearing the edge guide 25 is formed on the bottom portion of the stacker 24. The clearance portion 24B consists of a concave portion that is recessed across a range in which it is possible to move the edge guide 25 in the width direction X at a position that is relative to the pair of edge guides 25 in the bottom portion of the stacker 24. The pair of edge guides 25 is provided to be slidable in the width direction X in conjunction with each other via a linking mechanism (neither is shown) with respect to a square plate shape substrate that configures the supply tray 23. That is, the pair of edge guides 25 move in conjunction when one is operated in the direction in which both gaps are widened, the other also moves in a direction in which the gaps are widened, and move in conjunction when one is operated in the direction in which both gaps are narrowed, the other also moves in a direction in which the gaps are narrowed. The movement range of the pair of edge guides 25 is set in a range in which it is possible to guide the medium M from an assumed minimum width to an assumed maximum width (for example, A4 or A3 width). Wherever the pair of edge guides 25 are positioned in the width direction X, a portion of the pair of edge guides 25 enters the clearance portion 24B when the stacker 24 lowers to a height position that is indicated in FIG. 6.

The stacker 24 is able to lower to a lower limit position ZL, which is indicated in FIG. 15, to not contact the medium M on the supply tray 23 when the load capacity of the medium M that is loaded on the supply tray 23 is a specific load capacity Zm1, which will be described later, or more. In addition, the stacker 24 is able to lower to the lower limit position ZL, which is indicated in FIG. 16, to not contact the medium M on the supply tray 23 when the load capacity of the medium M that is loaded on the supply tray 23 is less than the specific load capacity Zm1. The stacker 24 and the supply tray 23 overlap each other in the horizontal direction by the upper end portion of the edge guide 25, that is a portion of the supply tray 23, entering the clearance portion 24B with a concave shape of the stacker 24 while the stacker 24 lowers to the lower limit position ZL that is indicated in FIG. 16 (refer to FIG. 16). Therefore, in particular, the lower limit position ZL that is indicated in FIG. 16 of the stacker 24 is set to be relatively low when the load capacity of the medium M on the supply tray 23 is less than the specific load capacity Zm1.

Next, referring to FIG. 7, position control (lifting control) that moves the stacker 24 up and down will be described. The control portion 80, which will be described later, positionally controls the stacker 24 in a range up to the lower limit position ZL according to the load capacity (load height) of the recording medium M1 that is loaded on the receiving surface 24A of the stacker 24. However, at the lower limit position ZL, the physically lowering limit position ZLo of the stacker 24 is set as the lowest position, and the lower limit position ZL is a position that changes at the side above the lowering limit position ZLo according to the load capacity of the medium M on the supply tray 23. In a case where the upper limit position of the stacker 24 is referenced, a lowerable distance ZD that is a distance from the upper limit position to the lower limit position ZL changes according to the load capacity of the medium M on the supply tray 23, and is calculated according to the following Formula (1).

$$ZD = Zo - (Zh\max - Zh) \quad (1)$$

In this arrangement, Zo is a lowering limit distance from the upper limit position of the stacker 24 to the physically lowering limit position ZLo, Zhmax is a lifting limit distance (maximum lifting amount) of the hopper 27, and Zh is a lifting distance (lifting amount) of the hopper 27. The lowering limit position ZLo of the stacker 24 is set to an upper position by the predetermined margin distance (for example, predetermined value in the range of 1 to 10 mm) with respect to the higher position out of a position at which, for example, the lower surface (bottom surface) of the stacker 24 abuts against a revolving shaft 43A and a position at which the stacker 24 abuts against the upper end portion of the edge guide 25 that enters the clearance portion 24B. The lifting limit distance Zhmax is equivalent to a distance when the hopper 27, in which there is no medium M, abuts against the pickup roller 41 from the standby position. The lifting distance Zh is equivalent to the lifting amount of the hopper 27 from the standby position during printing, and changes according to the medium load capacity on the hopper 27.

Figure 7:
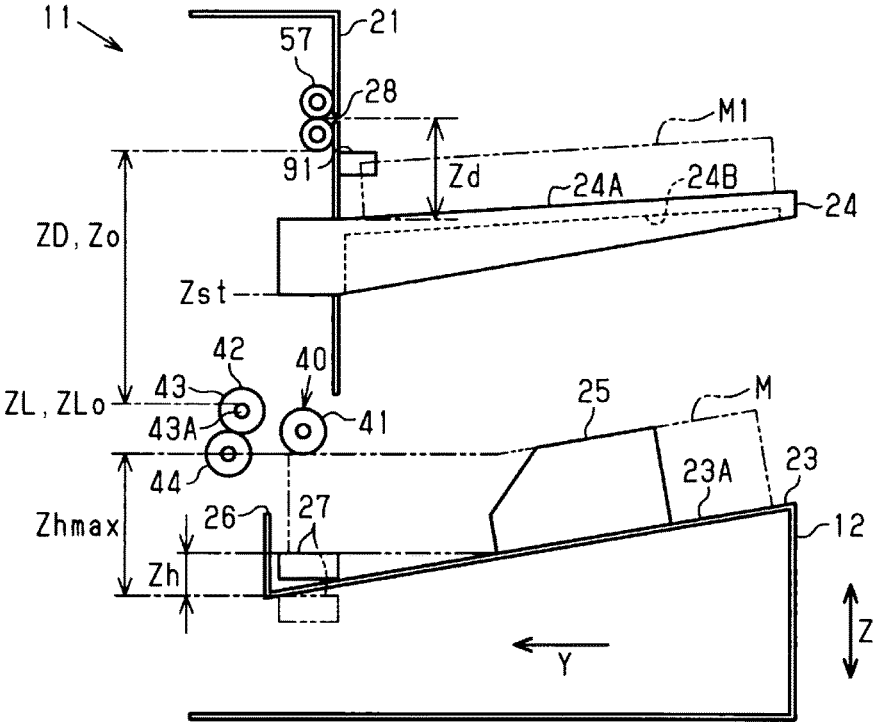
FIG. 7 is a schematic view that explains a calculation method for a lower limit position of the stacker.

As shown in FIG. 7, in the recording apparatus 11, the detecting portion that detects the load capacity of the recording medium M1 on the stacker 24 and a first sensor 91, as an example of the first detecting portion, are attached. The first sensor 91 of the example is attached at a position below the position (that is, a nip position of the discharge roller 57) of the discharge port 28 in the casing 12, and detects that the load height of the recording medium M1 on the stacker 24 reaches a set height. The first sensor 91 consists of an optical sensor such as, for example, a photo coupler that has a light emitting portion and a light receiving portion at both sides that interpose the region in which the medium M1 is discharged from the discharge port 28 in the width direction X. When the control portion 80 blocks light between the light emitting portion and the light receiving portion that configure the first sensor 91 across a certain time or more, it is determined that the load capacity of the recording medium M1 on the stacker 24 reaches the set height that is slightly lower than the limit height at which it is possible to smoothly receive the recording medium M1 that is discharged from the discharge port 28 on the receiving surface 24A. In detail, the control portion 80 monitors a detection state of the first sensor 91 during a certain time at each timing at which discharge of the medium M1 is finished, if the detection state continues across the certain time, it is determined that the recording medium M1 on the stacker 24 reaches the set height. Then, the control portion 80 controls a movement position Zst (position in the vertical direction Z) of the stacker 24 by lowering the stacker 24 by increments of a predetermined amount to a degree that the recording medium M1 on the stacker 24 reaches the set height.

In addition, the recording apparatus 11 is provided with a second sensor 92 (refer to FIGS. 8, 15, and the like) that configures an example of the second detecting portion that is able to detect the lifting amount Zh from the standby position, which is indicated by a two-dot chain line in FIG. 7, of the hopper 27. The recording apparatus 11 is provided with a third sensor 93 as an example of the third detecting portion that is able to detect the stacker 24 when the lowering limit position ZLo is reached that is indicated in FIG. 16. In this arrangement, the lowering limit position ZLo is set to an upper position by the predetermined margin distance with respect to the higher position out of a position at which, for example, the base portion lower surface of the stacker 24 abuts against a revolving shaft 43A and a position at which the stacker 24 abuts against the upper end portion of the edge guide 25 that enters the clearance portion 24B. The control portion 80 of the example sets the lowering limit position ZLo, which is indicated in FIG. 7, of the stacker 24 that is detected by the third sensor 93 as the origin, measures (counts) the position of the stacker 24 in a direction from the origin toward the upper side in the vertical direction Z, and acquires the movement position Zst, which is indicated in FIG. 7, of the stacker 24 based on the measurement value (count value). On a measurement scale in which the lowering limit position ZLo is the origin, the lower limit position ZL of the stacker 24, which changes according to the load capacity of the medium M on the supply tray 23, is indicated in the following Formula (2).

$$ZL = Zh\max - Zh - Zm1 \quad (2)$$

In this arrangement, Zm1 is the specific load capacity (specific load distance) that is equivalent to the load capacity of the medium M when the position when the stacker 24 abuts against the upper end portion of the edge guide 25 that enters the clearance portion 24B and the position when the lower surface of the stacker 24 abuts against the medium M on the supply tray 23 are the same. The item (Zhmax−Zh) in Formula (2) is equivalent to the load capacity Zm (hereinafter referred to as "medium load capacity Zm") of the medium M on the supply tray 23. From the calculation result in Formula (2) in which the medium load capacity Zm on the supply tray 23 (=Zhmax−Zh) is less than the specific load capacity Zm1, the lower limit position ZL, which is indicated in FIG. 16, is determined in which the edge guide 25 enters up to a predetermined depth in the clearance portion 24B of the stacker 24. The lower limit position ZL in this case is equivalent to, for example, the lowering limit position ZLo, and ZL=0. Meanwhile, from the calculation result in Formula (2) in which the medium load capacity Zm on the supply tray 23 is the specific load capacity Zm1 or more, the lower limit position ZL, which is indicated in FIG. 15, is determined that changes according to the medium load capacity Zm of the supply tray 23.

Figure 11:
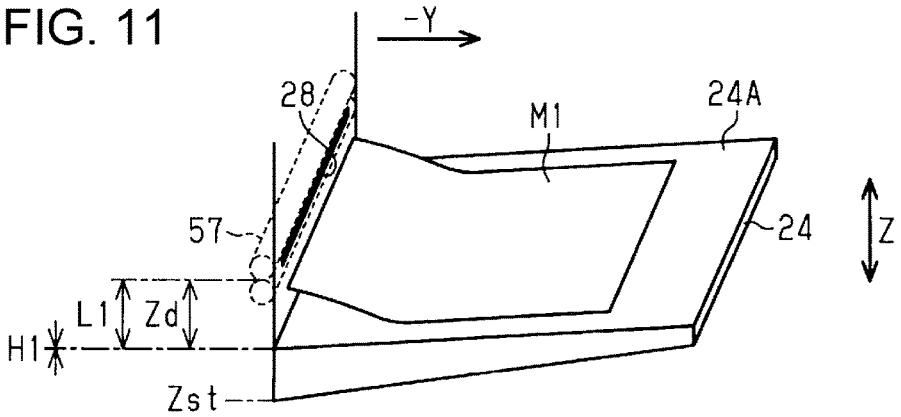
FIG. 11 is a schematic perspective view illustrating a state when starting medium loading of the stacker of the present embodiment.
Figure 12:
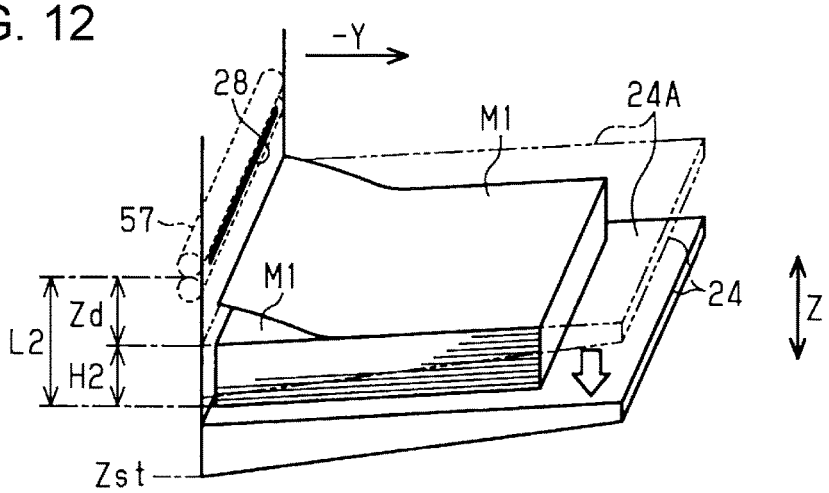
FIG. 12 is a schematic perspective view illustrating a circumstance of moving the same stacker.

The stacker 24 moves in the vertical direction Z in a range until reaching the lower limit position ZL (refer to FIGS. 15 and 16). As shown in FIGS. 11 and 12, the stacker 24 is positionally controlled such that the dropping distance Zd that is a height from the discharge position of the discharge port 28 (nip position of the pair of discharge rollers 57) up to the receiving surface 24A of the stacker 24 or the uppermost surface of the recording medium M1 on the receiving surface 24A so as to fit within a predetermined range of a set distance Zf or less.

The stacker 24 moves by changing the distance in the vertical direction Z from the discharge port 28 to the stacker 24. As shown in FIGS. 11 and 12, the distance of the stacker 24 is positionally controlled such that a second distance L2 when a second load height H2 is higher than a first load height H1 is longer than a first distance L1 when the load height of the received recording medium M1 is a first load height H1. In the example that is indicated in FIG. 11, for the first distance L1, L1=0 when the recording medium M1 is not loaded, but when the recording medium M1 is loaded on the stacker 24, the stacker 24 is positionally controlled such that the second distance L2 is longer than the first distance L1 when the first load height H1 and the second load height H2 satisfy 0<H1<H2.

In addition, in other words, the stacker 24 is positionally controlled so as to move while maintaining the dropping distance Zd of the recording medium M1 that drops from the discharge port 28 toward the stacker 24 in a predetermined range that is shorter than the movement range of the stacker 24 in the vertical direction Z. In this arrangement, the movement range of the stacker 24 in the vertical direction Z is a range in which it is possible to move the stacker 24 from the upper limit position up to the lower limit position ZL. The dropping distance Zd is shorter than the movement range of the stacker 24. Consequently, the stacker 24 is positionally controlled such that the dropping distance Zd fits the predetermined range of the set distance Zf or less that is shorter than the movement range. Note that, in the example in FIG. 7, the lower side reference position at which the dropping distance Zd is determined is the position of the base portion that becomes the shortest of the receiving surface 24A of the stacker 24, but for example, the dropping distance Zd may be determined with the position on the receiving surface 24A that is separated from the base end of the stacker 24 by the predetermined distance (for example, predetermined value within the range of 1 to 20 cm) in the discharge direction (−Y direction) as the reference position.

Figure 8:
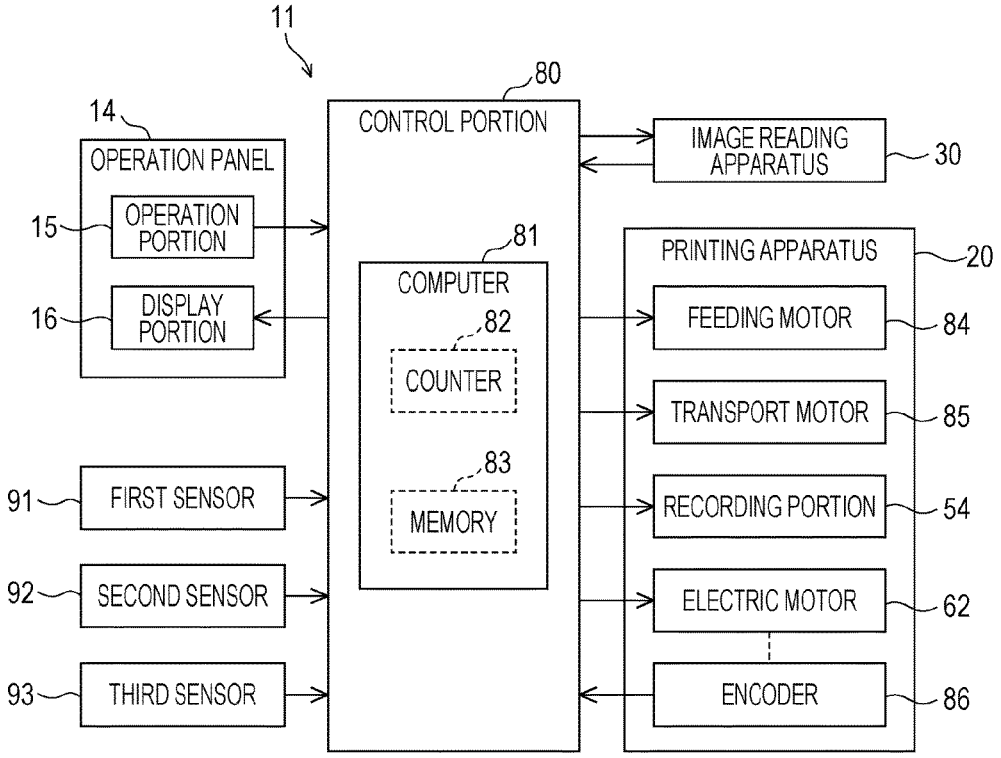
FIG. 8 is a block view illustrating an electrical configuration of the recording apparatus.

Next, an electrical configuration of the recording apparatus 11 will be described with reference to FIG. 8. As shown in FIG. 8, the control portion 80 that collectively controls the recording apparatus 11 is provided with, for example, a computer 81 that consists of an LSI or the like. The computer 81 has a built-in central processing unit (CPU) and an application specific IC (ASIC). In addition, the computer 81 is provided with a counter 82 and a memory 83. The counter 82 is used in a counting process or the like for measuring the movement position Zst of the stacker 24. For example, the memory 83 consists of a RAM and a non-volatile memory, and stores a program or the like that is executed by the computer 81.

The control portion 80 is electrically connected to the operation panel 14, the printing apparatus 20, and the image reading apparatus 30 via an interface that is not illustrated. The printing apparatus 20 has the feeding motor 84, the transport motor 85, the recording portion 54, the electric motor 62, and the encoder 86 as electrical constituent elements, and the constituent elements are electrically connected to the control portion 80.

The control portion 80 controls the feeding motor 84, the transport motor 85, and the recording portion 54 based on printing data that is received by the recording apparatus 11 from a host device (not shown) such as a host computer or the like, and an image or the like is printed on the medium M. In addition, the control portion 80 controls each motor 84 and 85 and the recording portion 54 based on and the printing data that is generated based on instructed image data and printing condition information when an instructed printing instruction is received by the user operating the operation portion 15, and an image or the like is printed on the medium M.

The control portion 80 causes one selected from the first feeding portion 40 and the second feeding portion 45 to drive by the driving of the feeding motor 84, and feeds the medium M from the cassette 22 or the supply tray 23. In addition, the control portion 80 causes the pair of rollers 53 to rotate by the driving of the transport motor 85, and transports the fed medium M along the transport passage 52. The control portion 80 controls the recording portion 54 to drive based on printing data, and prints an image or the like on the medium M based on the printing data at a printing position on the transport passage 52.

In addition, the control portion 80 moves the stacker 24 up and down by causing the electric motor 62 to drive forward and in reverse. The control portion 80 inputs a pulse signal that includes the number of pulses proportionally to the amount of movement of the stacker 24 from the encoder 86, counts the number of pulse edges of the input pulse signal in the counter 82, and acquires the movement position Zst of the stacker 24 from the counted value. For the encoder 86, a rotary encoder that is able to detect rotation of the electric motor 62 or rotation of a rotating body such as the pulley 63 or the pinion 74 that constitute the movement mechanism 60, a linear encoder that is able to directly or indirectly detect a change of the stacker 24 in the vertical direction Z, or the like could be adopted. In addition, in place of the encoder 86, the electric motor 62 may be set as a stepping motor, and may be configured so as to count in the counter 82 the number of steps that are used for control of the electric motor 62 by the control portion 80, and acquire the movement position Zst of the stacker 24 from the counted value.

Figure 9:
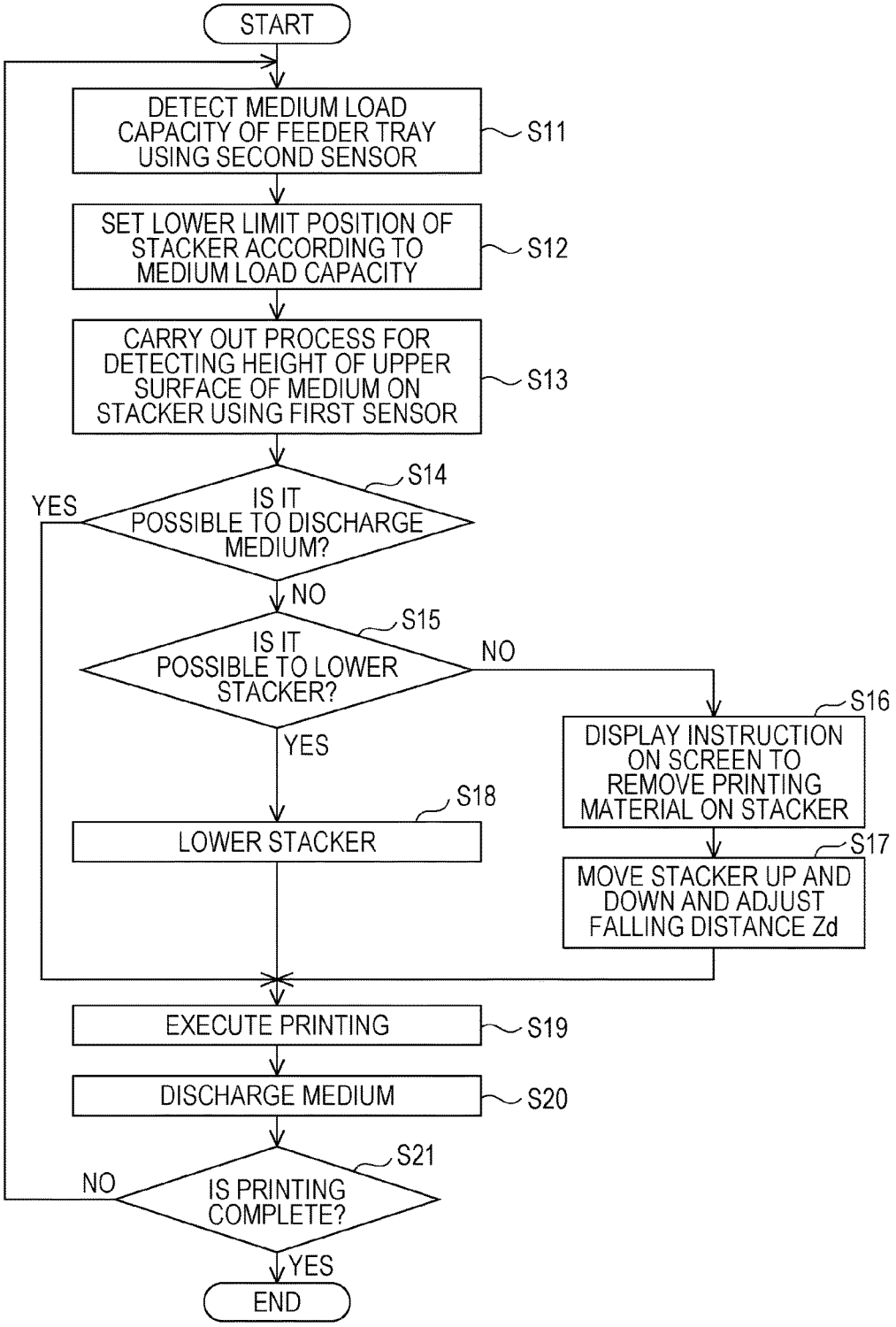
FIG. 9 is a flow chart illustrating a program for printing control.

A program for printing control, which is indicated in the flow chart in FIG. 9, is stored in the memory 83 as one example of the program. The computer 81 of the control portion 80 performs positional control of the stacker 24 in the vertical direction Z along with printing control by executing the program for printing control that is indicated in FIG. 9. As shown in FIG. 8, the control portion 80 acquires various necessary detection values upon performing position control of the stacker 24, and is electrically connected to the first sensor 91, the second sensor 92, and the third sensor 93 described above.

The first sensor 91 constitutes an optical sensor such as a photo coupler that is indicated in FIG. 7, and detects that the recording medium M1 on the stacker 24 reaches the set height according to the position of the discharge port 28. The control portion 80 causes the electric motor 62 to drive to lower the stacker 24 by a set value when input from the first sensor 91 is switched from a non-detection signal (off signal) to a detection signal (on signal). In this manner, the control portion 80 maintains the dropping distance Zd from the discharge port 28 up to the upper surface of the recording medium M1 on the stacker 24 to the set distance Zf or less by controlling the position of the movement position Zst of the stacker 24 according to the detection result of the first sensor 91. The set value is set to a predetermined value, for example, within the range of 1 to 10 mm. In this case, the falling speed of the stacker 24 may be fast or slow, but preferably, is a speed (for example, 2 cm/second or less) at which it is possible to smoothly perform landing after the recording medium M1 drops without movement of the stacker 24 being conspicuous. In addition, as long as the predetermined amount is, for example, 5 mm or less, falling of the stacker 24 is continuously controlled, and it is easy for the user to recognize when the stacker 24 continuously falls.

In this arrangement, even if the stacker 24 falls by the predetermined amount, the predetermined amount is set to a value at which the dropping distance Zd satisfies the conditions of fitting within the range of the set distance Zf or less without impairing alignment of the recording medium M1 on the stacker 24 by randomly moving the recording medium M1 by air resistance while dropping. Therefore, even if the stacker 24 falls by the predetermined amount, the dropping distance Zd directly after falling ends satisfies the condition of being the set distance Zf or less. The set distance Zf that is the maximum permissible value of the dropping distance Zd is set to a predetermined value, for example, within the range of 5 to 30 mm. Therefore, for the recording medium M1 that is discharged from the discharge port 28, alignment of the recording medium bundle that is loaded on the stacker 24 is enhanced and the amount of random movement of the recording medium M1 when there is air resistance while dropping is suppressed to be relatively small since the drop of the comparatively small dropping distance Zd of the set distance Zf or less is sufficient.

In addition, the second sensor 92 detects the lifting amount Zh of the hopper 27 from the standby position (origin position). When there is no medium M on the supply tray 23, the hopper 27 is lifted up to the supply position to abut against the pickup roller 41 (FIG. 16), and in that case, the second sensor 92 detects the maximum lifting amount Zhmax as the lifting amount Zh (FIG. 7). In addition, when the medium M is on the supply tray 23, the second sensor 92 detects the lifting amount Zh of the hopper 27 when the hopper 27 is lifted up to the supply position so that the uppermost surface of the medium M on the hopper 27 abuts against the pickup roller 41 (FIG. 15). In the embodiment, an example of the second detecting portion is configured by the second sensor 92 and the computer 81 that calculates the lower limit position ZL based on Formula (2) using the lifting amount Zh of the hopper 27 that is the detection value of the second sensor 92. Then, the control portion 80 restricts the range in which the stacker 24, which is positioned above the supply tray 23, is lowered to the lower limit position ZL. That is, the control portion 80 causes the stacker 24 to move in the range of the lower limit position ZL or more.

The third sensor 93 detects the physical lowering limit position ZLo of the stacker 24. In this arrangement, the lowering limit position ZLo is set at a slightly upper position where the stacker 24 does not hit one of the revolving shaft 43A and the edge guide 25 according to the position of one of the revolving shaft 43A and the edge guide 25 that first hit during the lowering process. The control portion 80 acquires the lowering limit position ZLo by the third sensor 93 detecting the stacker 24 at the lowering limit position ZLo. When the third sensor 93 detects the stacker 24 at the lowering limit position ZLo, the upper end portion of the edge guide 25 is in a state of entering the clearance portion 24B of the stacker 24. Note that, the third sensor 93 may be either of a contact sensor or a non-contact sensor as long as it is possible to detect that the stacker 24 reaches the physical lowering limit position ZLo.

Next, the action of the recording apparatus 11 will be described. The recording apparatus 11 detects the lowering limit position ZLo using the third sensor 93 by causing the stacker 24 to lower in a state in which it is possible to confirm that there is no medium M on the supply tray 23. When the third sensor 93 detects that the stacker 24 reaches the lowering limit position ZLo, the control portion 80 sets the movement position Zst of the stacker 24 at that time as the origin position, and resets the counter 82. That is, the control portion 80 sets the position of the stacker 24, when the third sensor 93 detects the stacker 24, as the lowering limit position ZLo by performing an origin setting operation. The origin setting operation is regularly or irregularly performed in a state in which it is possible to confirm that there is no medium M on the supply tray 23. A period in which it is possible to detect or confirm that there is no medium on the supply tray 23 is given as an example of the implementation period of the origin setting operation, during pre-shipment inspection of the recording apparatus 11, when the power supply of the recording apparatus 11 is turned on, or during the non-printing period after activation. As a case where it is possible to detect that there is no medium M on the supply tray 23, an example is given of a case where it is possible to detect that there is no medium M on the supply tray 23 based on a detection result of a medium presence or absence sensor, when for example, a medium presence or absence sensor is provided that is able to detect the presence or absence of the medium M on the supply tray 23. As a case where it is possible to confirm that there is no medium M on the supply tray 23, an example is given of a case where it is possible for the control portion 80 to confirm that the medium is removed by displaying on the display portion 16 a message to prompt total removal of the medium M from the supply tray 23, and notifying the confirmation to the recording apparatus 11 by the predetermined operation of the operation portion 15 after the user totally removes the medium M from the supply tray 23.

Figure 13:
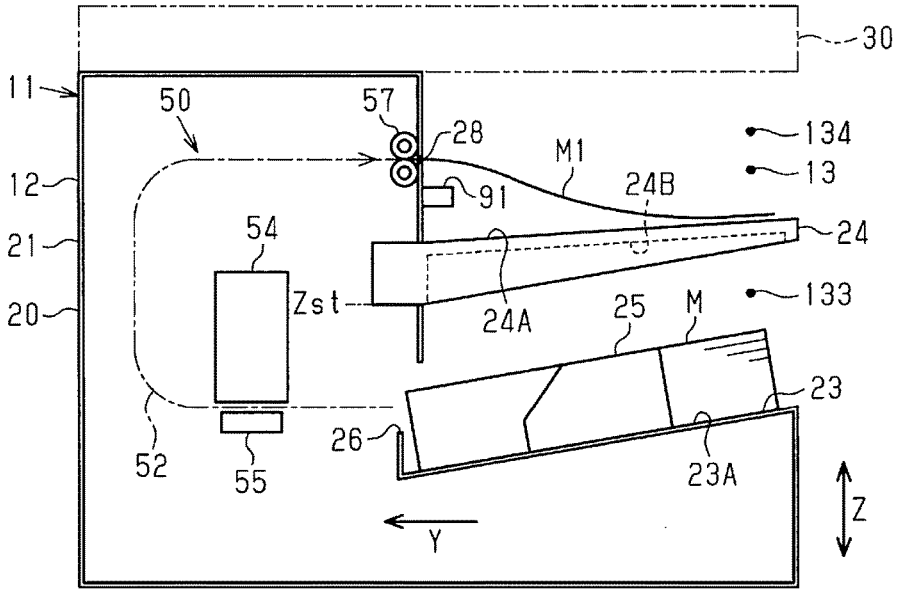
FIG. 13 is a schematic side sectional view illustrating a state when the medium loading of the stacker starts in the recording apparatus.

In addition, the control portion 80 adjusts the position of the stacker 24 in the vertical direction Z such that a condition is satisfied in which the dropping distance Zd is maintained at the set distance Zf or less based on the detection result of the first sensor 91 which detects the load capacity of the recording medium M1 on the stacker 24 when the origin setting operation is complete, or therebefore initial operation is complete when the origin setting operation is omitted. The stacker 24 satisfies the condition of the dropping distance Zd being the set distance Zf or less, and for example, the position of the stacker 24 is adjusted to the initial position that is indicated in FIG. 13.

The recording apparatus 11 receives the printing data from, for example, the host computer. The printing data includes information that designates a feeding origin of one of the cassette 22 and the supply tray 23, and for example, the supply tray 23 is designated as the feeding origin. When an instruction is received to start printing by receiving the printing data, the control portion 80 causes the feeding motor 84 to drive, lifts the hopper 27 via a lifting mechanism, which is not illustrated, and presses the medium M on the supply tray 23 against the pickup roller 41. After that, the control portion 80 starts printing control that is indicated in the flow chart in FIG. 9.

Figure 10:
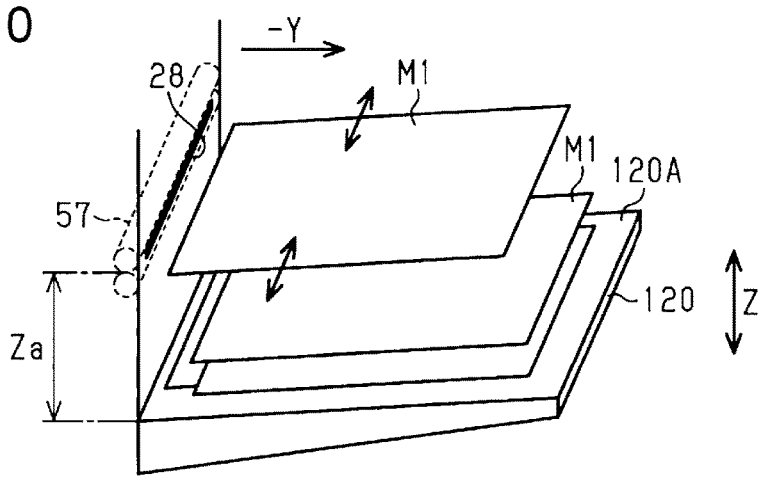
FIG. 10 is a schematic perspective view illustrating a circumstance of when a medium is loaded in a stacker of a comparative example.

In this arrangement, a stacker 120 of a comparative example, which is indicated in FIG. 10, is fixed at a predetermined height in the vertical direction Z, therefore the dropping distance Za of the recording medium M1 from the discharge port 28 to a receiving surface 120A is relatively long. In this case, as shown in FIG. 10, the recording medium M1 while dropping randomly moves due to air resistance, and the longer the dropping distance Za, the larger the positional deviation amount of the recording medium M1 becomes when dropping on the stacker 120, therefore alignment of the recording medium bundle on the stacker 120 is worsened. Therefore, in the embodiment, the control portion 80 performs printing control that is indicated by the flow chart in FIG. 9, and as shown in FIGS. 11 and 12, controls the position of the movement position Zst of the stacker 24 such that a condition is satisfied in which the dropping distance Zd of the recording medium M1 from the discharge port 28 is maintained within a predetermined range of the set distance Zf or less according to the load capacity of the recording medium M1 on the receiving surface 24A.

First, in step S11, the control portion 80 detects the medium load capacity of the supply tray 23 using the second sensor 92. In this arrangement, the hopper 27 lifts from the standby position to the supply position at which the medium M on the supply tray 23 abuts against the pickup roller 41 (refer to FIGS. 7 and 15), therefore the lifting amount Zh is dependent on the medium load capacity of the supply tray 23. Therefore, the lifting amount Zh of the hopper 27 that is lifted when printing starts is detected by the second sensor 92, and the medium load capacity (medium load capacity height) of the supply tray 23 is acquired based on the detected lifting amount Zh.

In step S12, the control portion 80 sets the lower limit position of the stacker 24 according to the medium load capacity. That is, the computer 81 calculates the lowerable distance ZD from the upper limit position of the stacker 24 to the lower limit position ZL based on Formula (1) using the lifting amount Zh of the hopper 27. Then, the computer 81 calculates the lower limit position ZL, at which the lowering limit position ZLo is set as the origin, based on Formula (2). In this manner, the computer 81 sets the calculated lower limit position ZL (=Zhmax−Zh−Zm1) by writing to a predetermined storage region of the memory 83.

In step S13, the control portion 80 performs an upper surface height detection process for detecting the upper surface height of the medium M1 on the stacker 24 using the second sensor 91. In the example, as the upper surface height detection process, the control portion 80 performs a process for determining whether or not the first sensor 91 is in a detection state and the upper surface height of the recording medium M1 on the stacker 24 has already reached the set height according to the position of the discharge port 28. The first sensor 91 is in a detection state when the upper surface of the recording medium M1 has already reached the set height, for example, as indicated by a two-dot chain line on the stacker 24 that is indicated in FIG. 7. Meanwhile, the first sensor 91 is in a non-detection state when the upper surface of the recording medium M1 on the stacker 24 has not yet reached the set height. Note that, the first sensor 91 may be configured by a non-contact sensor that is able to detect the upper surface height of the recording medium M1 on the stacker 24 with non-contact, and the upper surface height may be detected based on the detection value of the first sensor 91.

In step S14, the control portion 80 determines whether or not discharge of the medium M1 is possible. For example, the control portion 80 determines that it is possible to discharge the recording medium M1 to the stacker 24 while, for example, the upper surface height (load capacity) of the recording medium M1 on the stacker 24 is less than the set height that is equivalent to the load capacity at which discharge of the recording medium M1 to the stacker 24 is prohibited. Meanwhile, the control portion 80 determines that it is not possible to discharge the recording medium M1 when the upper surface height of the recording medium M1 on the stacker 24 has already reached the set height that is equivalent to the load capacity at which discharge of the recording medium M1 to the stacker 24 is prohibited. If discharge of the medium M1 is not possible, the process proceeds to the subsequent step S15, and if discharge of the medium M1 is possible, the process proceeds to step S19. Note that, the set height is not limited to the set height that is equivalent to the load capacity at which discharge of the recording medium M1 to the stacker 24 is prohibited, and may be set to a set height that is lower than the prohibited load capacity (load height) by a predetermined margin height.

In step S15, the control portion 80 determines whether or not the stacker 24 is lowerable. In detail, the stacker 24 is lowerable until reaching the lower limit position ZL, but it is not possible to lower to a position that is lower than the lower limit position ZL. Therefore, the control portion 80 determines whether or not the stacker 24 is lowerable based on a determination of whether or not the stacker 24 has reached the lower limit position ZL. In a case where the stacker 24 is not able to be lowered after already reaching the lower limit position ZL, the process proceeds to step S16, and if it is possible to lower the stacker 24 that has not yet reached the lower limit position ZL from the current position, the process proceeds to step S18.

In step S16, the control portion 80 displays on a screen of the display portion 16 an instruction for removing the printing material on the stacker 24. That is, the control portion 80 displays on the display portion 16 instruction information such as a message to prompt removal of the printing material on the stacker 24. The user who views the screen of the display portion 16 removes the recording medium M1 on the stacker 24 according to the instruction information such as a message. Subsequently, the user notifies the removal of the recording medium M1 on the stacker 24 to the recording apparatus 11 by operating the operation portion 15. When notification is given, the control portion 80 proceeds to the process of step S17.

In step S17, the control portion 80 causes the stacker 24 to move up and down, and adjusts the position such that the dropping distance Zd fits the range of the set distance Zf or less. There is a case where the user totally removes the recording medium bundle on the stacker 24, and a case where the user removes a portion of the recording medium bundle on the stacker 24. The control portion 80 lifts the stacker 24 toward the upper limit position while monitoring the measurement value that indicates the movement position Zst of the stacker 24 for which the lowering limit position ZLo is set as the origin, and if the first sensor 91 does not detect anything during lifting, the stacker 24 is stopped at the upper limit position. Meanwhile, if the recording medium M1 on the stacker 24 is detected by the first sensor 91 during lifting of the stacker 24, the stacker 24 from the movement position Zst during detection is lowered by a predetermined amount and stopped. Thereby, in a case where there is no recording medium M1 on the stacker 24, it is possible to maintain the dropping distance Zd from the discharge port 28 to the upper surface of the stacker 24 at the set distance Zf or less, and in a case where the recording medium M1 is on the stacker 24, it is possible to maintain the dropping distance Zd from the discharge port 28 to the upper surface of the recording medium M1 of the stacker 24 at the set distance Zf or less. After adjustment of the dropping distance Zd, the control portion 80 proceeds to the process of step S19.

Meanwhile, in step S18, the control portion 80 causes the stacker 24 to lower. That is, in a case where it is determined that it is not possible to lower the stacker 24 in step S15 and the process proceeds to step S18, the control portion 80 causes the stacker 24 to lower by the predetermined amount (predetermined distance) that is determined in advance. The predetermined amount is set to a value that is the dropping distance Zd of the set distance Zf or less and at which the amount of positional deviation on the receiving surface 24A of the recording medium M1 due to influence of air resistance while dropping fits within the maximum permissible value. For example, the predetermined amount is a value within the range of 1 to 10 mm (≤Zf). Therefore, the dropping distance Zd is maintained at the value of the set distance Zf or less by lowering the stacker 24 from the position by a predetermined amount until the upper surface height of the recording medium M1 on the stacker 24 reaches the set height. At that time, lowering of the stacker 24 by the predetermined amount may be performed immediately at high-speed (for example, 10 cm/second or more), and may be performed slowly at low speed (for example, 2 cm/second or less). For example, in a case where the stacker 24 is lowered at low speed, an impact during the lowering operation of the stacker 24 is suppressed to be small upon movement of the stacker 24 being difficult to recognize when viewed by the user.

In the subsequent step S19, the control portion 80 executes printing. That is, the control portion 80 prints an image on the recording portion 54 based on the printing data with respect to the medium M that is transported by feeding or transporting the medium M by controlling driving of the feeding motor 84, the transport motor 85, and the recording portion 54 based on the printing data. In a case where the recording portion 54 uses a line recording method, the medium M is transported at a certain speed, and line printing is performed in which the recording portion 54 prints at once by a width of one line on the medium M during transport at the certain speed. Meanwhile, in a case where the recording portion 54 uses a serial recording method, serial printing is performed in which a transport operation in which the medium M is intermittently transported and a recording operation in which between transport operations, a carriage (not shown) that constitutes the recording portion 54 moves in a main scanning direction (width direction X) and by the movement process, a recording head that constitutes the recording portion 54 discharges ink and records by a width of one line are approximately alternately performed.

In step S20, the control portion 80 discharges the medium M1. That is, the control portion 80 causes the transport motor 85 to drive by a predetermined amount of rotation and discharges the recording medium M1 from the discharge port 28 after printing by rotation of each of the pair of rollers 53 (including a pair of discharge rollers 57) when the recording portion 54 completes printing of the image on the medium M based on the printing data. The recording medium M1 that is discharged from the discharge port 28 is loaded on the receiving surface 24A of the stacker 24 or the upper surface of the recording medium M1 on the receiving surface 24A. For example, as shown in FIGS. 11 and 13, one sheet of the recording medium M1 that is discharged from the discharge port 28 is received by the stacker 24. In this case, the dropping distance Zd satisfies the condition of being a value within the range of the set distance Zf or less, therefore the random movement due to influence of air resistance in the dropping process is suppressed to be small. As a result, positional deviation of the load position of the recording medium M1 on the stacker 24 is suppressed to be small.

In step S21, the control portion 80 determines whether or not printing has ended based on the printing data. If it is before the end of printing (negative determination in S21), the process returns to step S11. Then, the control portion 80 repeats the processes of steps S11 to S21. In this manner, the control portion 80 sets the lower limit position ZL of the stacker 24 according to the medium load capacity on the supply tray 23 that is determined from the detection value of the second sensor 92 until printing (print job) ends based on the printing data (S11, S12).

Figure 14:
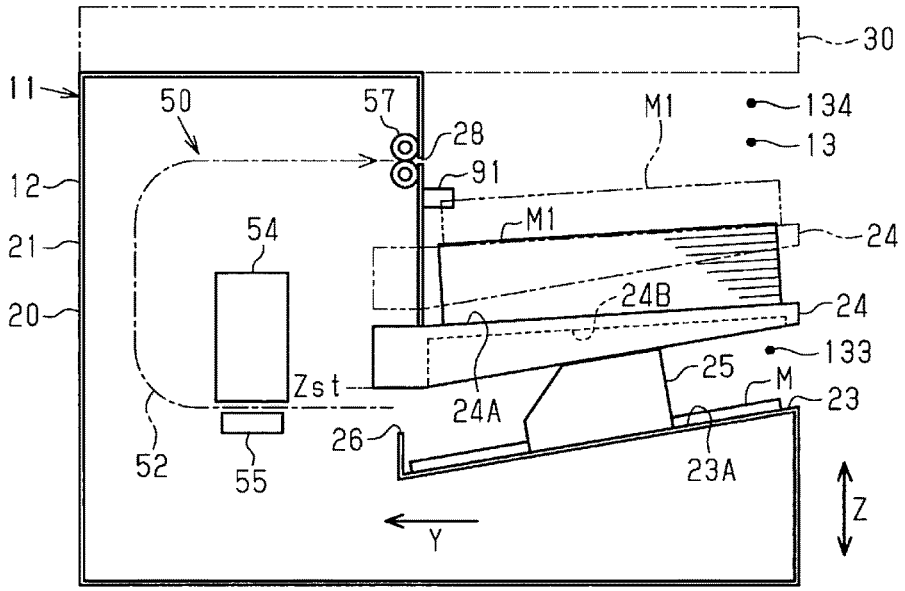
FIG. 14 is a schematic side sectional view illustrating a medium loading state of a stacker near the end of printing in the recording apparatus.

Then, the recording medium M1 that is discharged from the discharge port 28 one sheet at a time is loaded sequentially on the stacker 24. In this case, the dropping distance Zd of the recording medium M1 fits within the range of the set distance Zf or less, therefore the random movement due to influence of air resistance of the recording medium M1 while dropping is suppressed to be small, and positional deviation of the recording medium M1 that is loaded on the receiving surface 24A is suppressed to be small. After that, as shown in FIG. 14, when the recording medium M1 on the stacker 24 reaches the set height that is indicated by the two-dot chain line in FIG. 14, the first sensor 91 detects the situation, and sets discharge of the recording medium M1 from the discharge port 28 to a not possible state (prohibited state) (negative determination in S14). In this case, if the stacker 24 is lowerable when the stacker 24 has not yet reached the lower limit position ZL (affirmative determination in S15), the stacker 24 is lowered by the predetermined amount (S18). When discharge of the medium M1 from the discharge port 28 is possible when the first sensor 91 is in the non-detection state due to lowering of the stacker 24, printing (S19) on the next medium M and discharge (S20) of the recording medium M1 are performed. Then, when discharge of the recording medium M1 from the discharge port 28 on the stacker 24 proceeds, the first sensor 91 detects again the recording medium M1 on the stacker 24. When discharge again of the recording medium M1 from the discharge port 28 is not possible according to the detection of the first sensor 91 (negative determination in S14), in this case, if lowering of the stacker 24 is possible (positive determination in S15), the stacker 24 is lowered by the predetermined amount (S18). In this manner, the stacker 24 satisfies the condition of the dropping distance Zd being the set distance Zf or less and sequential lowering is repeated during printing, and for example, is lowered to the movement position Zst that is indicated by a solid line in FIGS. 12 and 14. In addition, during printing, the medium load capacity on the supply tray 23 reduces as indicated in FIG. 14 in conjunction with printing proceeding, therefore, in conjunction with the reduction, the set lower limit position ZL of the stacker 24 is gradually shifted down (S12).

In addition, as shown for example, in FIG. 15, in a case where the medium M on the supply tray 23 is at the specific load capacity Zm1 or more as the medium M is replenished and the like in the supply tray 23 during printing, the lower limit position ZL is set to the position immediately before at which the stacker 24 abuts against the uppermost surface of the medium M on the supply tray 23. That is, the lower limit position ZL changes upwards according to replenishment of the medium M. In this case, the stacker 24 is able to be lowered to the lower limit position ZL, which is indicated in FIG. 15, immediately before the bottom portion of the stacker 24 abuts against the uppermost surface of the medium M on the supply tray 23.

In addition, as shown in FIG. 16, in a case where the medium M1 on the supply tray 23 is less than the specific load capacity Zm1, the lower limit position ZL is set to the position immediately before the stacker 24 abuts against the edge guide 25. In particular, in the embodiment, at least a portion of the edge guide 25 on the bottom portion of the stacker 24 is insertable into the clearance portion 24B with a concave shape, therefore the stacker 24 is able to be lowered to the lower limit position ZL, which is indicated in FIG. 16, at which the upper end portion of the edge guide 25 enters the clearance portion 24B of the bottom portion of the stacker 24. At this time, the stacker 24 and the supply tray 23 have a positional relationship so as to overlap each other in the horizontal direction. In this manner, the lower limit position ZL of the stacker 24 is set as low as permissible according to the load capacity of the medium M on the supply tray 23, thereby it is possible to secure the maximum load capacity of the recording medium M1 in the stacker 24 to be relatively great.

According to the embodiment described above, it is possible to obtain the effects indicated below.

(1) The recording apparatus 11 is provided with the supply tray 23 on which the medium M is mounted before recording, the recording portion 54 that records on the medium M which is supplied from the supply tray 23, the casing 12 which has the discharge port 28 that discharges the recorded medium M1, and the stacker 24 (an example of the recording portion) which is disposed above the supply tray 23 and that receives the recording medium M1 that is discharged from the discharge port 28. The supply tray 23 and the stacker 24 overlap each other in the vertical direction Z. The stacker 24 moves by changing the distance in the vertical direction Z from the discharge port 28 to the stacker 24. At this time, the stacker 24 moves to a position at which the second distance L2 when a second load height H2 is higher than the first load height H1 is longer than the first distance L1 that is the distance when the load height of the received medium M1 is the first load height H1. Furthermore, the stacker 24 has the clearance portion 24B into which a portion of the supply tray 23 enters while the stacker 24 lowers to the lower limit position ZL. Therefore, the stacker 24 and the supply tray 23 overlap each other in the horizontal direction by the portion of the supply tray 23 entering the clearance portion 24B while the stacker 24 lowers to the lower limit position ZL. Therefore, it is possible to set the lower limit position ZL of the stacker 24 to be relatively low, and it is possible to secure the load capacity of the recording medium M1 that is possible to load on the stacker 24 to be relatively great. Consequently, it is possible to increase the load capacity of the medium M1 in the stacker 24 in a configuration provided with the supply tray 23 and the stacker 24. In addition, for the received medium M1, the second distance L2 when the second load height H2 (>H1) is longer than the first distance L1 when the first load height H1, therefore it is possible to maintain the dropping distance Zd of the medium M1 from the discharge port 28 at the set distance Zf or less, and it is possible to load the medium bundle on the stacker 24 with good alignment.

(2) The recording apparatus 11 is provided with the supply tray 23 on which the medium M is mounted before recording, the recording portion 54 that records on the medium M that is supplied from the supply tray 23, the casing 12 that has the discharge port 28 that discharges the recorded medium M1, and the stacker 24 (an example of the recording portion) which is disposed above the supply tray 23 and that receives the recording medium M1 that is discharged from the discharge port 28. The supply tray 23 and the stacker 24 overlap each other in the vertical direction Z. The stacker 24 positionally moves while maintaining the dropping distance Zd of the medium that falls from the discharge port 28 toward the stacker 24 in a predetermined range of the set distance Zf or less that is shorter than the movement range of the stacker 24 in the vertical direction Z. Furthermore, the stacker 24 has the clearance portion 24B into which a portion of the supply tray 23 enters while the stacker 24 lowers to the lower limit position ZL. Therefore, the stacker 24 and the supply tray 23 overlap each other in the horizontal direction by the portion of the supply tray 23 entering the clearance portion 24B while the stacker 24 lowers to the lower limit position ZL. Therefore, it is possible to set the lower limit position ZL of the stacker 24 to be relatively low, and it is possible to relatively greatly secure the load capacity of the recording medium M1 that is possible to load on the stacker 24. Consequently, it is possible to increase the load capacity of the medium M1 in the stacker 24 in a configuration provided with the supply tray 23 and the stacker 24. In addition, the stacker 24 is moved while the dropping distance Zd is maintained in the predetermined range, therefore it is possible to load the medium bundle on the stacker 24 with good alignment.

(3) The supply tray 23 includes an edge guide that is able to position the loaded medium M in the width direction X, and at least a portion of the edge guide 25 enters the clearance portion 24B while the stacker 24 lowers to the lower limit position. Consequently, at least a portion of the edge guide 25 enters the clearance portion 24B while the stacker 24 lowers to the lower limit position, and it is possible to lower the stacker 24 to a position overlapping the edge guide 25 in the horizontal direction. Therefore, it is possible to increase the load capacity of the medium M1 in the stacker 24.

(4) The recording apparatus 11 is provided with a cassette 22 (an example of the medium accommodating portion) that accommodates the medium before supply to the recording portion 54, and the cassette 22, the supply tray 23, and the stacker 24 overlap each other in the vertical direction Z. Consequently, since the cassette 22, the supply tray 23, and the stacker 24 overlap each other in the vertical direction Z, it is possible to suppress the size to be small in a direction that intersects with the vertical direction Z of the recording apparatus 11, and the installation space of the recording apparatus 11 is suppressed to be small.

(5) The recording apparatus 11 is further provided with the movement mechanism 60 that moves the stacker 24 up and down, and the control portion 80 that controls the movement position Zst of the stacker 24 by moving the movement mechanism 60. The control portion 80 controls the position to which the stacker 24 lowers based on the load capacity of the recording medium M1 on the stacker 24. Therefore, the stacker 24 is lowered to an appropriate position according to the load capacity of the recording medium M1, and it is possible to maintain the stacker 24 at a relatively small dropping distance Zd (≤Zf). Consequently, it is possible to load the recording medium M1 on the stacker 24 to be better aligned.

(6) The recording apparatus 11 is further provided with the first sensor 91 as an example of the detecting portion that detects the load capacity of the recording medium M1 on the stacker 24. The control portion 80 maintains the dropping distance Zd from the discharge port 28 up to the upper surface of the recording medium M1 on the stacker 24 to the set distance Zf or less according to the detection result of the first sensor 91. Thereby, the control portion 80 controls the movement position Zst of the stacker 24. Consequently, since the dropping distance Zd is maintained at a set distance Zf or less, it is possible to suppress positional deviation of the recording medium M1 to be small when falling on the stacker 24 in comparison to a configuration in which a sufficiently long dropping distance drops at which the medium M1 exceeds the set distance Zf. Consequently, it is possible to load the recording medium bundle on the stacker 24 to be better aligned.

(7) The second sensor 92 is further provided that detects the lower limit position ZL of the stacker 24 which is determined from the positional relationship between the stacker 24 and the supply tray 23 or the medium M on the supply tray 23. The control portion 80 causes the stacker 24 to move in the range of the lower limit position ZL or more that is detected by the second sensor 92. That is, the lower limit when the stacker 24 moves is limited to the lower limit position ZL that is detected by the second sensor 92. Consequently, it is possible to avoid the lowered stacker 24 interfering with the supply tray 23 or the medium M on the supply tray 23.

(8) The second sensor 92 detects the load capacity of the medium M on the supply tray 23, and the control portion 80 moves the stacker 24 in a range of the lower limit position ZL or more according to the load capacity of the medium M that is detected by the second sensor 92. Consequently, the stacker 24 is lowered as much as possible and it is possible to load a greater number of the recording medium M1 on the stacker 24 while avoiding interference between the stacker 24 and the medium M on the supply tray 23.

(9) The recording apparatus 11 is further provided with the display portion 16. The control portion 80 displays on the display portion 16 instruction information that prompts removal of the recording medium M1 that is discharged to the stacker 24 when the load capacity of the recording medium M1 that is detected by the first sensor 91 (example of detecting portion) is the load capacity at which discharge of the recording medium M1 from the discharge port 28 is prohibited in a state in which the stacker 24 reaches the lower limit position ZL. Consequently, it is possible to prompt removal of the recording medium M1 from the stacker 24 to the user who views the instruction information that is displayed on the display portion 16. Therefore, the recording apparatus 11 is able to avoid leaving printing without change.

(10) A third sensor 93 (example of the third detecting portion) is further provided that detects the stacker 24 at the lowering limit position ZLo. The control portion 80 causes the stacker 24 to lower until the third sensor 93 detects the stacker 24 when there is no medium M on the supply tray 23, and sets the lowering limit position ZLo of the stacker 24. Therefore, for example, in a case where the lowering limit position ZLo that is detected by the third sensor 93 is set as the origin and the movement position Zst of the stacker 24 is measured, it is possible to accurately measure the movement position Zst of the stacker 24. Therefore, it is possible to increase precision of the position control of the stacker 24. In addition, since it is possible to reliably stop the stacker 24 at the lowering limit position ZLo based on the detection result of the third sensor 93, it is possible to reliably avoid interference between with other components (revolving shaft 43A or edge guide 25) and the stacker 24.

Note that, it is also possible to modify the embodiments in the following aspects.

Figure 17:
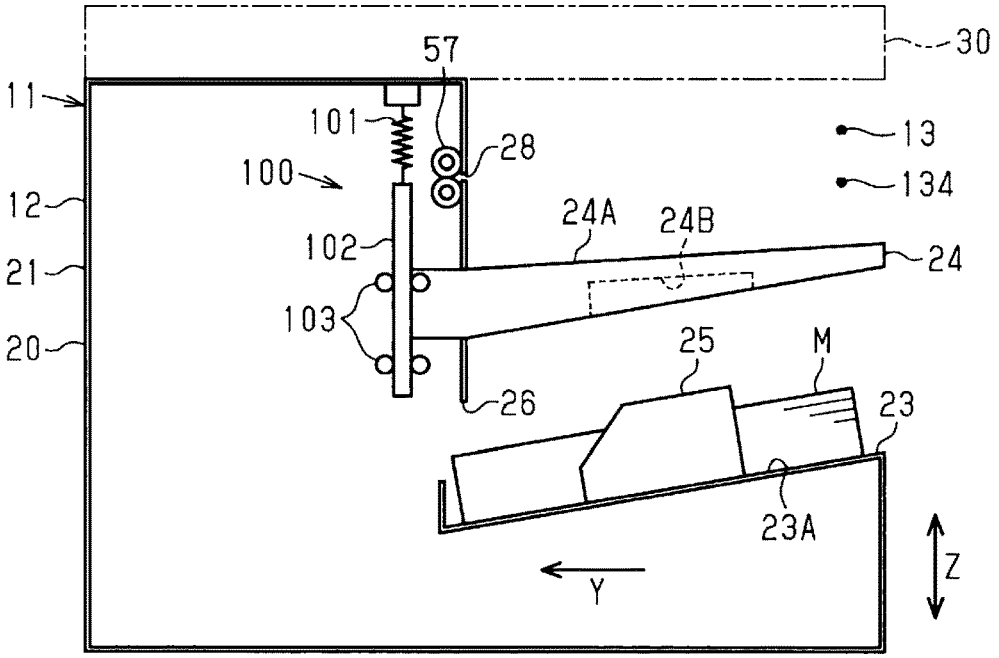
FIG. 17 is a schematic side sectional view illustrating a movement mechanism of a stacker in a recording apparatus of a modification example.

The movement mechanism of the stacker 24 is not limited to an electric type. The movement mechanism may be a spring type movement mechanism 100 that is indicated in FIG. 17. The movement mechanism 100 that is indicated in FIG. 17 is provided with a tension spring 101 that biases the stacker 24 upward. One end (upper end) of the tension spring 101 is attached in a hanging state by being fixed to the upper wall (top plate) of the casing 12, and the other end (lower end) of the tension spring 101 is fixed to the upper end of a plate shape guide member 102 that is fixed to the base portion of the stacker 24. The guide member 102 is interposed by a plurality of pairs of guide rollers 103 and is guided in a state of being movable in the vertical direction Z. In a state in which there is no recording medium M1 on the receiving surface 24A, the stacker 24 is disposed at a position within the range that satisfies the condition of the dropping distance Zd being the set distance Zf or less from the discharge port 28 to the receiving surface 24A. The stacker 24 lowers against the upward biasing force of the tension spring 101 by the self weight of the stacker 24 and the loaded recording medium M1 in conjunction with an increase in the medium load capacity. Therefore, it is possible to maintain the dropping distance Zd that satisfies the condition of being the set distance Zf or more while securing the loadable medium load capacity in the stacker 24 to be great. In addition, the clearance portion 24B into which it is possible to insert at least a portion of the edge guide 25 when moved in a direction that is close to the supply tray 23 is recessed into the lower surface of the stacker 24. When the edge guide 25 enters the clearance portion 24B while the stacker 24 lowers to the lower limit position, the stacker 24 and the edge guide 25 of the supply tray 23 overlap each other in the horizontal direction. Note that, in the example that is indicated in FIG. 17, the stacker 24 is biased upward by the biasing force of the tension spring 101, but the stacker 24 may be biased upward by the biasing force of a compression spring, and the stacker 24 may be configured to be lowered by self weight according to the medium load capacity. In addition, a biasing portion that biases the stacker 24 upward may be a damper.

Figure 18:
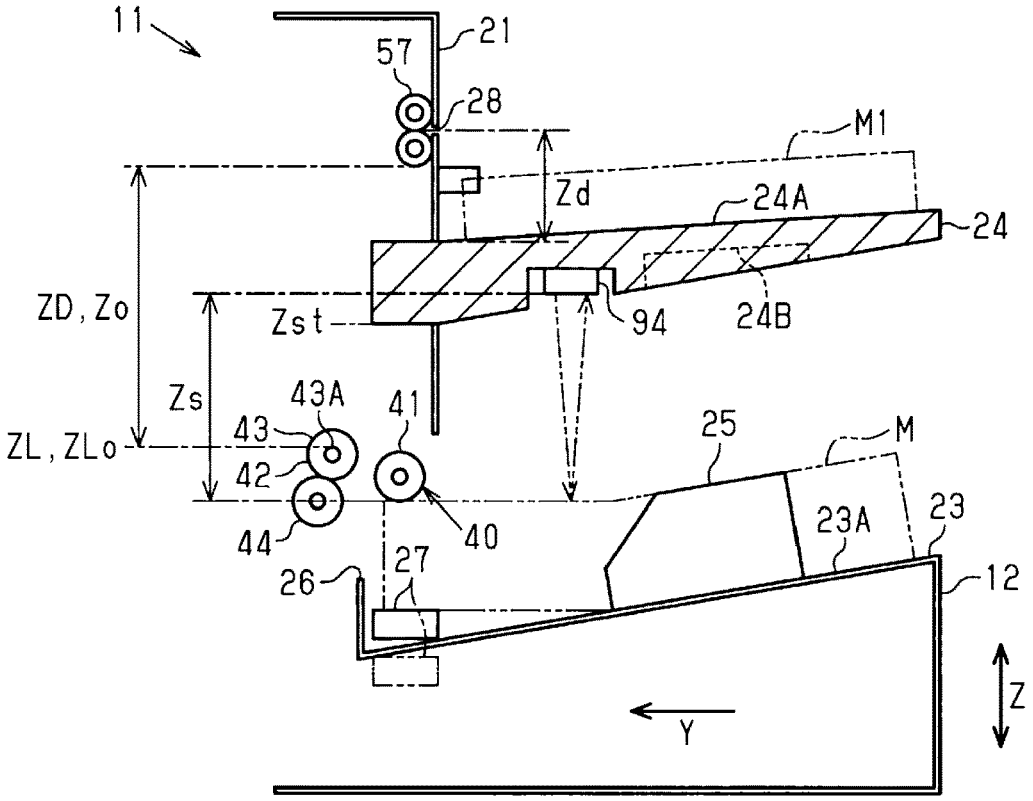
FIG. 18 is a schematic side sectional view illustrating a configuration in which a medium is detected on the supply tray in the modification example.

The second detecting portion may be set as the second sensor 94 (example of the second detecting portion), which is indicated in FIG. 18, that is able to detect the upper surface height of the medium M that is loaded on the supply tray 23 in place of the second sensor 92 that detects the lifting amount Zh of the hopper 27. The second sensor 94, which is indicated in FIG. 18, is attached in a state of being disposed on the concave portion in the bottom portion of the stacker 24. The second sensor 94 is a non-contact sensor, and the detection region of the second sensor 94 orients the upper surface of the medium M on the supply tray 23. The second sensor 94 has a wave transmission portion (for example, light emitting portion) that emits detection waves (for example, visible light, detection light made of electromagnetic waves such as infrared rays, sound waves, or the like) toward the upper surface of the medium M on the supply tray 23, and a wave reception portion (for example, light receiving portion) that detects reflected waves (for example, reflected light) in which the detection waves (for example, detection light) is reflected on the upper surface of the medium M. Then, the second sensor 94 detects the distance Zs from the bottom portion of the stacker 24 known to the device by measurement up to the upper surface of the medium M on the supply tray 23, and detects the upper surface height of the medium M on the supply tray 23 based on the position of the stacker 24 and the detected distance Zs. The clearance portion 24B into which it is possible to insert at least a portion of the edge guide 25 when the stacker 24 is moved in a direction that is close to the supply tray 23 is recessed into the lower surface of the stacker 24 that is indicated in FIG. 18. When the edge guide 25 enters the clearance portion 24B while the stacker 24 lowers to the lower limit position, the stacker 24 and the edge guide 25 of the supply tray 23 overlap each other in the horizontal direction. Note that, the second sensor 94 is not limited to the optical sensor that detects light as the detection waves, and as long as it is possible to acquire the detection value that is equivalent to the distance Zs up to the upper surface of the medium M on the supply tray 23, the second sensor 94 may be a non-contact sensor that uses sound waves, radio waves, electromagnetic waves of other light, and the like as the detection waves. In addition, the second sensor 94 may be fixed at a position at which it is possible to set the detection region by orienting the upper surface of the medium M on the supply tray 23 in the casing 12 in place of the bottom portion of the stacker 24.

Figure 19:
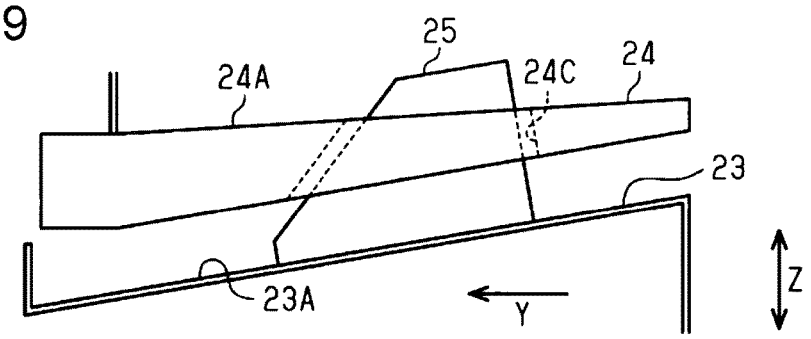
FIG. 19 is a schematic side sectional view illustrating a lower limit position of the stacker when there is no medium in the supply tray in the recording apparatus of the modification example.
Figure 20:
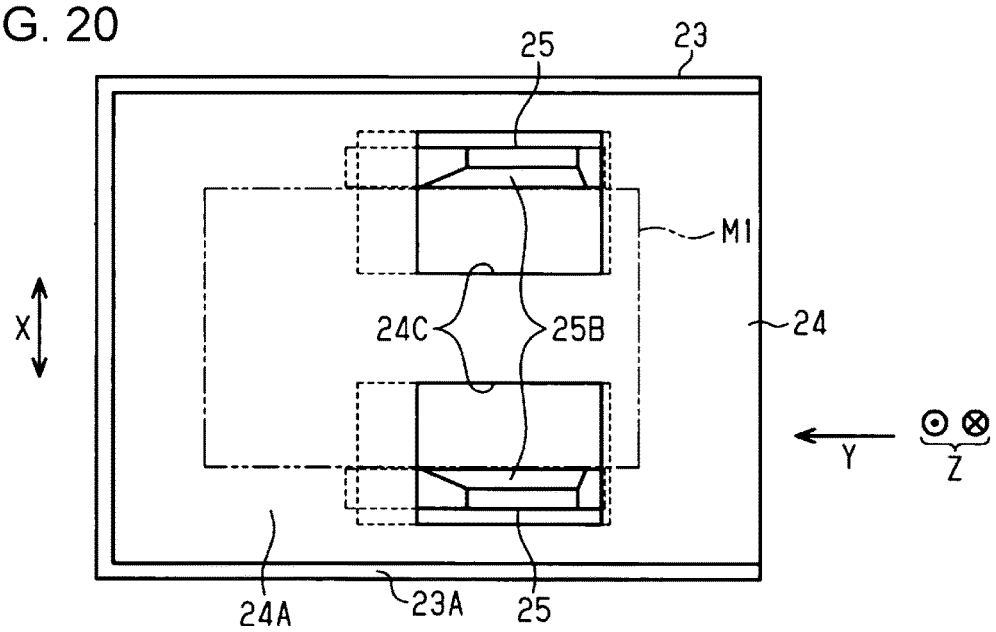
FIG. 20 is a schematic planar view illustrating a stacker and a supply tray in a recording apparatus of a modification example.

As shown in FIGS. 19 and 20, the edge guide 25 may protrude through from the stacker 24. That is, as shown in FIGS. 19 and 20, in the stacker 24, a through-hole 24C is formed in a part that corresponds to the edge guide 25. As shown in FIG. 20, the through-hole 24C is open across a range in which it is possible for a pair of edge guides 25 to move in the width direction X. As shown in FIG. 19, the pair of edge guides 25 protrude upward of the stacker 24 through the through-hole 24C in a state in which the stacker 24 lowers to the lower limit position. In this arrangement, as shown in FIG. 20, the upper portion of the pair of edge guides 25 is formed in an inclined surface 25B that expands to the outside in the width direction while going upward, and the gap in the width direction X of a part that protrudes upward more the stacker 24 of the pair of edge guides 25 is slightly wider than the width of the recording medium M1 that is indicated by a two-dot chain line in FIG. 20. In this arrangement, the width of the medium M on the supply tray 23 and the width of the recording medium M1 that is discharged on the stacker 24 are fundamentally the same. Therefore, impairment of alignment of the recording medium M1 on the stacker 24 by the part that protrudes of the pair of edge guides 25 tends not to occur. Moreover, while the load capacity on the stacker 24 is small, the recording medium M1 is guided in the width direction X by a protruding part of the pair of edge guides 25, and contributes to alignment improvement of the recording medium M1 in the width direction X. According to this configuration, it is possible to set the position of the lowering limit position ZLo of the stacker 24 further to the lower side than in the embodiment, and it is possible to load a greater number of the recording medium M1 on the stacker 24.

Figure 21:
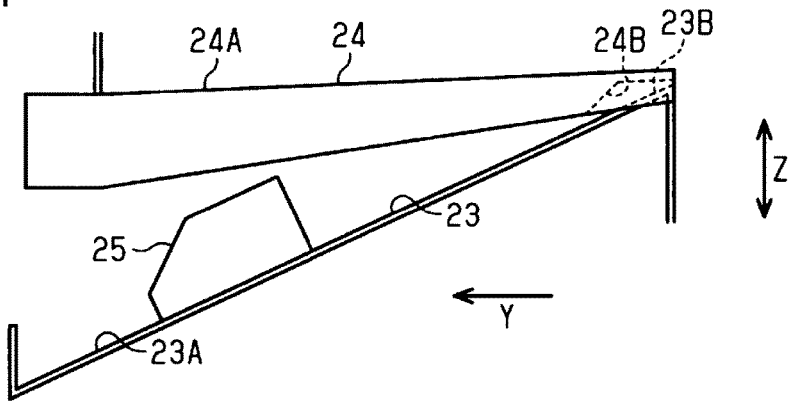
FIG. 21 is a schematic side sectional view illustrating a lower limit position of the stacker when there is no medium in the supply tray in the recording apparatus of a modification example that is different from that of FIG. 20.

The clearance portion that is recessed into a part that faces the supply tray 23 in the stacker 24 is limited to a configuration in which the edge guide 25 is cleared. For example, a portion other than the edge guide 25 of the supply tray 23 may be configured so as to be inserted or pass through the clearance portion of the stacker 24. For example, as shown in FIG. 21, in a case where an inclination angle of the supply tray 23 is comparatively large in the stacker 24, at the lower limit position, the stacker 24 strikes the upstream end portion 23B in the feeding direction Y of the supply tray 23 earlier than the edge guide 25. The clearance portion 24B with a concave shape into which the upstream portion 23B of the supply tray 23 enters is formed on the bottom portion of the stacker 24. The stacker 24 and the supply tray 23 overlap each other in the horizontal direction by the upstream end portion 23B of the supply tray 23 entering the clearance portion 24B with a concave shape as indicated in FIG. 21 while the stacker 24 lowers to the lower limit position that is positioned close to the supply tray 23. In this configuration, by at least a portion other than the edge guide 25 in the supply tray 23 entering the clearance portion 24B, it is possible to lower the stacker 24 to a position overlapping the supply tray 23 in the horizontal direction, and thereby it is possible to secure the load capacity of the recording medium M1 on the stacker 24. Note that, the clearance portion 24B may be a through-hole in FIG. 21. In this case, at the lower limit position of the stacker 24, the upstream end portion 23B of the supply tray 23 that enters the clearance portion 24B may protrude upward from the receiving surface 24A, or may not protrude.

The stacker 24 may be lowered at a certain speed during printing. In addition, the lowering speed of the stacker 24 may be changed according to the medium size or the printing mode. For example, when the first medium size, the stacker 24 is lowered at a first speed, and when the second medium size that is larger than the first medium size, the stacker 24 is lowered at a second speed that is slower than the first speed. In addition, for example, when in a first printing mode, the stacker 24 is lowered at the first speed, and when in a second printing mode that has a slower printing speed than the first printing mode medium size, the stacker 24 is lowered at the second speed that is slower than the first speed. Note that, the first printing mode is a high-speed printing mode such as, for example, a draft print mode, and the second printing mode is, for example, a high definition print mode. The high definition print mode is a mode in which printing is performed at a higher resolution and at a lower speed than in the high-speed printing mode. In addition, even if the medium sizes are the same, in a case where time intervals for discharging from the discharge port 28 are different according to the printing area, the lowering speed of the stacker 24 may be changed at high-speed the smaller the printing area.

The stacker 24 may be regularly lowered. For example, the stacker 24 may be lowered by a specific distance that is determined in advance every time the predetermined time that is determined in advance elapses. The stacker 24 lowers by a predetermined distance within a range of 0.1 to 3.0 mm every time the predetermined time within the range, for example, of 1 to 30 seconds elapses.

The stacker 24 may be lowered according to the recording amount. For example, the number of sheets of the recording medium M1 that is discharged from the discharge port 28 may be counted, and the stacker 24 may be lowered according to the number of sheets. In addition, the lowering operation of the stacker 24 may be started at a timing at which the recording medium M1 is finished loading on the stacker 24 without the lowering operation of the stacker 24 being performed in the discharging of the recording medium M1.

The first sensor 91 that is an example of the first detecting portion is set as a distance sensor that is able to detect the distance up to the receiving surface 24A of the stacker 24 or the upper surface of the recording medium M1 on the receiving surface 24A, and the control portion 80 may be configured to acquire the load capacity of the recording medium M1 on the stacker 24 according to the detection distance of the distance sensor. In this case, the control portion 80 determines whether or not the load height of the medium M1 on the stacker 24 reaches the set height based on the detection distance of the distance sensor. In a case where a portion or the entirety of the recording medium bundle on the stacker 24 is removed by the user, the control portion 80 detects that the recording medium M1 is removed from the detection distance of the first sensor 91 that constitutes a distance sensor, and causes the stacker 24 to lift to the movement position Zst at which it is possible to maintain the dropping distance Zd that is acquired from the detection distance at the set distance Zf or less. In addition, the first detecting portion may be configured to manage a sensor that detects presence or absence of the recording medium M1 on the stacker 24 and the thickness and the number of sheets of the medium according to the medium type that is discharged on the stacker 24 after the sensor detects the state of no medium, estimate the load height by calculating the thickness and number of sheets, and determine whether or not the load height has reached the set height. Furthermore, the first detecting portion may be a contact sensor in place of a non-contact sensor such as an optical sensor or a distance sensor.

In the embodiment, there may be a through-hole in place of the clearance portion 24B of the stacker 24 in the concave portion. In this case, the edge guide 25 as indicated in FIG. 19 may not protrude to the upper side of the receiving surface 24A.

In the embodiment, in a case of a configuration in which the lower limit position ZL of the stacker 24 normally matches the physical lowering limit position ZLo, the third sensor 93 that detects the lowering limit position ZLo may serve as the second detecting portion and the third detecting portion.

In the embodiment, the supply tray 23 (mounting portion) and the stacker 24 (receiving portion) may overlap at a proportion of 80% or more in the concave portion 13 in the vertical direction Z, but may entirely overlap, and may overlap at a proportion of less than 80%. In short, as long as the mounting portion and the receiving portion overlap each other in the vertical direction Z, it is possible to suppress the installation space of the recording apparatus 11 to be relatively small according to the overlap amount of both elements.

The set distance Zf that is the maximum value of the dropping distance Zd may be changed according to the type of medium (medium type, medium size). The first set distance Zf1 when the first medium that has a first thickness at which it is easy for influence of air resistance while dropping to be received where, for example, the thickness (for example, paper thickness) of the medium is thin is set to be smaller than the second set distance Zf2 when the second medium that has a second thickness that is thicker than the first thickness and it is difficult for influence of air resistance to be received. In addition, the first set distance Zf1 when the first medium that has the first medium size at which it is easy for influence of air resistance while dropping to be received where, for example, the medium size is large is set to be smaller than the second set distance Zf2 when the second medium that has a second medium size that is smaller than the first medium size and it is difficult for influence of air resistance to be received. In addition, preferably, the predetermined amount per one rotation is changed in which the stacker 24 is lowered in combination with a change of the set distance Zf, and preferably, the predetermined amount per one rotation is reduced in which the stacker 24 is lowered, for example, the smaller the set distance Zf.

At least one of the mounting portion (supply tray 23) and the receiving portion (stacker 24) may protrude partially to the outside from at least one of the openings 131 and 132. For example, even if at least one of the mounting portion and the receiving portion protrude partially from the opening 131 on the front surface side, it is necessary that the front surface side originally secure the space that the user establishes, therefore whether protrusion is great or slight, there is no significant link to an increase of the installation space of the recording apparatus 11. In addition, even if at least one of, for example, the mounting portion and the receiving portion protrudes partially from the opening 132 on the side surface side, it is possible to suppress the installation space of the recording apparatus 11 to be relatively small in comparison to a configuration in which at least one of the mounting portion and the receiving portion almost entirely protrudes.

The opening of the concave portion 13 may be only one surface of the casing 12. For example, the opening may be only the opening 131 of the casing 12 on the front surface side, may be only the opening 132 on the side surface side of the casing 12, and may be only the opening on a depth side of the casing 12. In addition, in the embodiment, three openings may be provided by partially opening the depth side of the concave portion 13 and at least partially opening three side surfaces of the casing 12 on each surface. Furthermore, in a case where two openings of the concave portion are set, two openings may be provided on the side surface of the casing 12 and two surfaces on the depth surface, and two openings may be provided on the front surface of the casing 12 and two surfaces on the depth surface.

The movement mechanism of the stacker 24 is not limited to the belt-driving method and the gear-driving method, and for example, may be a ball screw driving method.

The direction in which the movement mechanism moves the stacker 24 up and down is not limited to the vertical direction Z, and may be movement in the direction of the vertical direction components. That is, as long as it is possible to displace the stacker 24 up and down, there may be a configuration in which the stacker 24 moves in an oblique direction that intersects at an acute angle with the vertical direction.

Without providing the hopper, the mounting portion may be a manual feeding portion (manual feed tray) that is able to feed the loaded medium M one sheet at a time. Even if the mounting portion is a manual feeding portion, as long as the receiving portion and the mounting portion overlap each other in the horizontal direction while the receiving portion lowers to the lower limit, it is possible to secure the medium load capacity in the receiving portion to be great.

The recording apparatus may be provided with a feeding portion that feeds out an elongated medium from a roll body such as roll paper. In this case, the elongated medium after printing is configured to be discharged from the discharge port 28 after being cut at a predetermined length by a cutter unit, and loaded on the stacker 24. The stacker 24 is able to be lowered to the lower limit position that overlaps with the supply tray 23 in the horizontal direction, therefore it is possible to secure the load capacity of the recording medium M1 that is able to be loaded on the stacker 24 to be great.

The control portion 80 may realize in co-operation of software by a computer that executes the program and hardware of an electronic circuit or the like, may realize by only software, and furthermore, may realize by only hardware by the electronic circuit of an application specific IC (ASIC) or the like.

The recording apparatus is not limited to an ink jet printer, and for example, may be a dot impact printer, a thermal transfer printer, and an electrophotographic printer.

The recording apparatus is not limited to a serial recording method and a line recording method, and may be a lateral scanning method in which the recording head (carriage) is movable in two directions of the main scanning direction and the sub-scanning direction.

The recording apparatus is not limited to a multifunction printer that has a plurality of functions that include a printing function, and may be a recording apparatus that is provided with only the printing function. In this case, preferably, an extending portion that covers above the stacker 24 is provided instead of the main body 31 of the image reading apparatus 30.

The recording apparatus is not limited to a recording apparatus in which an image or the like is printed on a medium such as a paper sheet or a film, and the recording apparatus may be an industrial recording apparatus that is used in manufacture of electronic components or the like using a printing technique (ink jet technique). The recording apparatus may be an industrial recording apparatus that, for example, discharges a liquid body in which particles of the functional material are dispersed or mixed in the liquid or a fluid body such as gel. As the type of industrial recording apparatus, for example, a liquid discharge apparatus may be given which discharges a liquid body including, in a dispersed or dissolved form, material such as an electrode material or color material (pixel material) which is used in manufacture and the like of a liquid crystal display, an electro-luminescence (EL) display, and a surface light emission display. Furthermore, the recording apparatus may be a three-dimensional ink jet printer that manufactures a three-dimensional model by discharging liquid such as a resin liquid. As long as the model (an example of the recording medium) that is formed on a base sheet (an example of the medium) that models a three-dimensional model is formed to be flat, a flat model may be received in a state of being superimposed on the receiving portion (stacker).

The entire disclosure of Japanese Patent Application No.: 2017-147021, filed on Jul. 28, 2017 and No.: 2018-035273, filed on Feb. 28, 2018 are expressly incorporated by reference herein.

What is claimed is:

1. A recording apparatus comprising:

a mounting portion that mounts a medium before recording;

a recording portion that records on the medium that is supplied from the mounting portion;

a discharge port that discharges the recorded medium; and a receiving portion that is disposed above the mounting portion, that is receives the medium that is discharged from the discharge port, and that is moved while changing the distance in the vertical direction from the discharge port, wherein the mounting portion and the receiving portion overlap each other in the vertical direction, and the receiving portion moves to a position at which a second distance that is the distance when a second load height is higher than a first load height is longer than a first distance that is the distance when the load height of the received medium is the first load height, and the receiving portion has an entering clearance portion which a part of the mounting portion enters in a process in which the receiving portion moves to a lower limit.

2. The recording apparatus according to claim 1, wherein the mounting portion includes an edge guide that is able to position the mounted medium in a width direction, and at least a portion of the edge guide enters the clearance portion while the receiving portion lowers to a lower limit.

3. The recording apparatus according to claim 2, further comprising:

a medium accommodating portion that accommodates the medium before the medium is supplied to the recording portion, wherein the medium accommodating portion, the mounting portion, and the receiving portion overlap each other in the vertical direction.

4. The recording apparatus according to claim 3, further comprising:

a movement mechanism that moves the receiving portion up and down; and a control portion that controls the movement position of the receiving portion by driving the movement mechanism, wherein the control portion controls the movement position of the receiving portion based on the medium load capacity on the receiving portion.

5. The recording apparatus according to claim 4, further comprising:

a detecting portion that detects the medium load capacity on the receiving portion, wherein the control portion controls the movement position of the receiving portion by maintaining the dropping distance up to the upper surface of the medium on the receiving portion at a set value or less according to the detection result of the detecting portion.

6. The recording apparatus according to claim 5, further comprising:

a second detecting portion that detects the lower limit position of the receiving portion that is determined from the positional relationship between the receiving portion and the mounting portion or the medium on the mounting portion in a case where the detecting portion is a first detecting portion, wherein the control portion moves the receiving portion in a range of the lower limit position or more at which the second detecting portion is detected.

7. The recording apparatus according to claim 6, wherein the second detecting portion detects the medium load capacity on the mounting portion, and the control portion moves the receiving portion in a range of the lower limit position or more according to the medium load capacity on the mounting portion that is detected by the second detecting portion.

8. The recording apparatus according to claim 7, further comprising:

a display portion, wherein the control portion causes the display portion to display instruction information to promote removal of the medium on the receiving portion when the medium load capacity that is detected by the detecting portion is load capacity in which discharge of the medium from the discharge port is prohibited in a state in which the receiving portion reaches the lower limit position.

9. The recording apparatus according to claim 8, further comprising:

a third detecting portion that detects the receiving portion that is the lowering limit position, wherein the control portion causes the receiving portion to lower until the third detecting portion detects the receiving portion when there is no medium on the mounting portion and the lowering limit position of the receiving portion is set.

* * * * *